US006206344B1

(12) United States Patent
Takahara

(10) Patent No.: US 6,206,344 B1
(45) Date of Patent: Mar. 27, 2001

(54) OIL DRAIN PLUG FOR OIL STORAGE VESSEL AND OIL DRAIN DEVICE USING SAME

(76) Inventor: Tamotsu Takahara, 22, Shinjukutori 1-chome, Tokuyama-shi, Yamaguchi 745-0056 (JP)

( * ) Notice: Subject to any disclaimer, the term of this patent is extended or adjusted under 35 U.S.C. 154(b) by 0 days.

(21) Appl. No.: 09/194,273

(22) PCT Filed: Mar. 19, 1998

(86) PCT No.: PCT/JP98/01189

§ 371 Date: Nov. 20, 1998

§ 102(e) Date: Nov. 20, 1998

(87) PCT Pub. No.: WO98/42962

PCT Pub. Date: Oct. 1, 1998

(30) Foreign Application Priority Data

Mar. 21, 1997 (JP) ..... 9-068249
Aug. 8, 1997 (JP) ..... 9-215099

(51) Int. Cl.[7] ..... F16L 29/00
(52) U.S. Cl. ..... 251/149.6; 222/501; 137/590
(58) Field of Search ..... 222/501; 251/149.6, 251/149.1, 322, 321; 137/590

(56) References Cited

U.S. PATENT DOCUMENTS 4,150,809 4/1979 Muller .
4,745,894 * 5/1988 Laipply et al. ..... 251/149.1
5,131,497 * 7/1992 Rogers ..... 137/590
5,133,484 * 7/1992 Globert et al. ..... 137/590
5,411,114 5/1995 Bedi et al. .
5,433,410 7/1995 Foltz .
5,755,269 * 5/1998 Venooker et al. ..... 222/501
5,816,298 * 10/1998 Stricklin et al. ..... 251/149.6

FOREIGN PATENT DOCUMENTS 0163584 12/1985 (EP) .
2370208 6/1978 (FR) .
2704901 11/1994 (FR) .

* cited by examiner

*Primary Examiner*—Kevin Shaver
*Assistant Examiner*—Eric Keasel
(74) *Attorney, Agent, or Firm*—Reed Smith LLP

(57) ABSTRACT

A valve body member (20) is movably accommodated in an oil drain through-hole (14) of a bolt member (11) secured to an oil pan (1), with a valve body (21) of the valve body member (20) being engaged with a valve seat **(12*a*) of the bolt member (11) by means of a spring (30) to constitute a normally-closed valve. The normally-closed valve is opened by forcing the valve body member (20) by an adapter (40) having an oil suction hose (463) connected thereto so that oil is drained off by a negative suction. At the same time, an elongated flexible tube (50) connected to the oil suction tube (463) is inserted from the adapter (40) through an opening of the valve body member (20) into the interior of the pan (1) to drain off the oil remaining on the bottom of the oil pan (1)**.

20 Claims, 19 Drawing Sheets

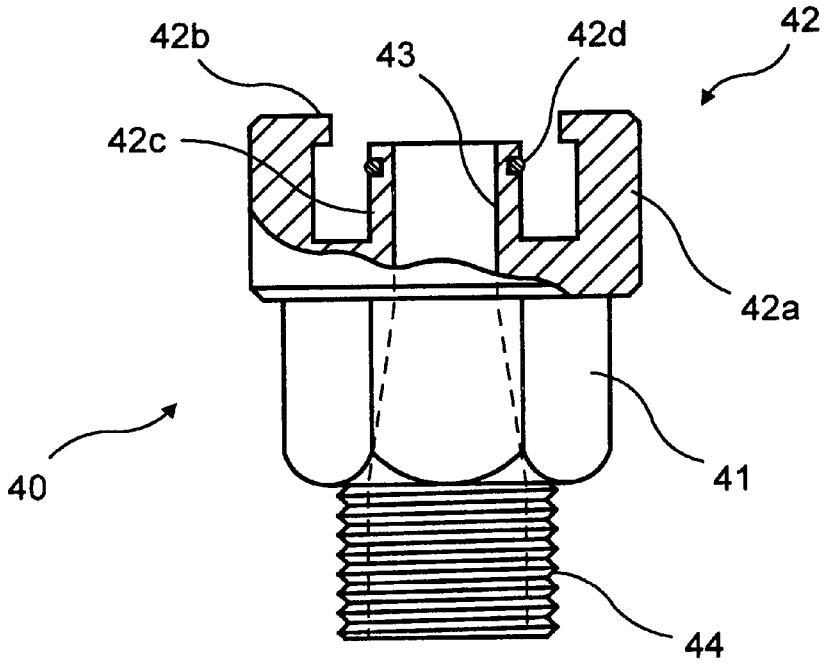
F I G. 5a
F I G. 5b
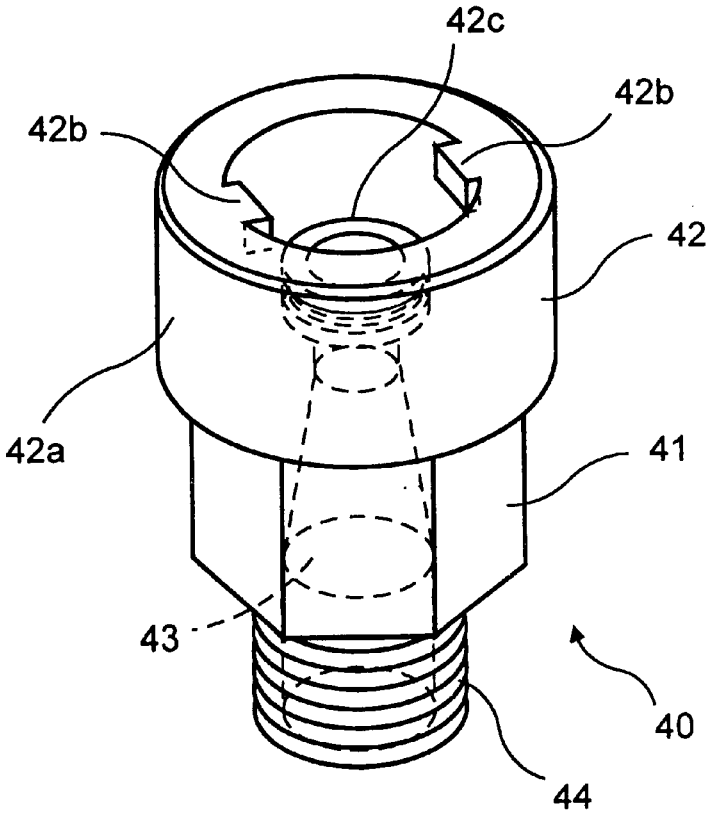

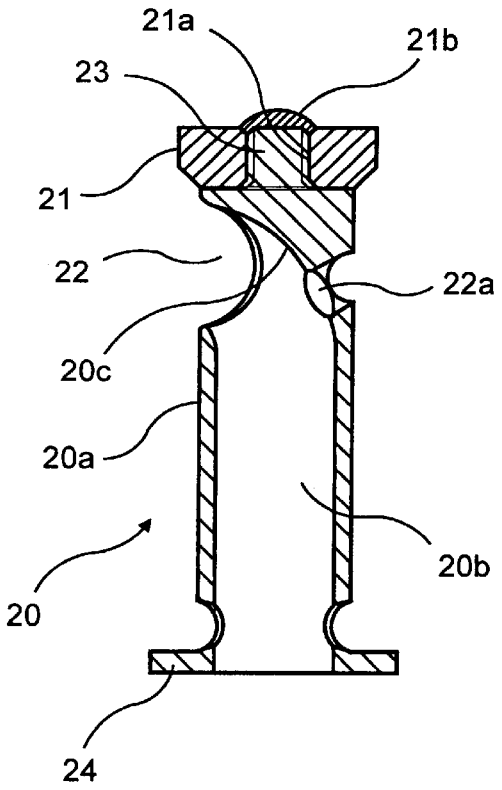
F I G. 6a
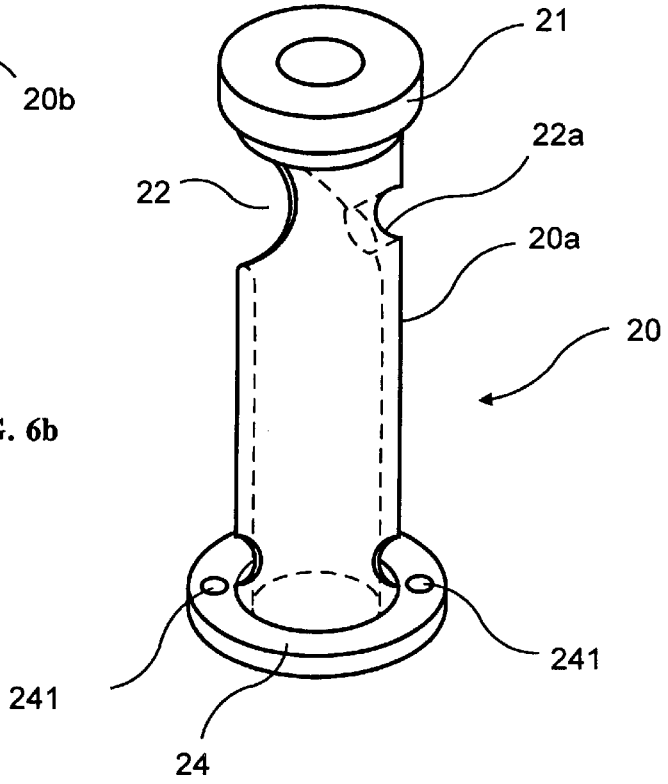
F I G. 6b
F I G. 6c
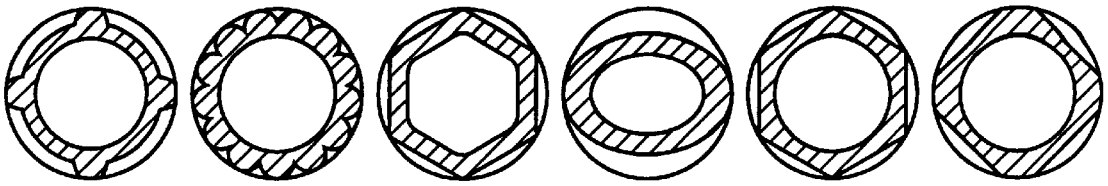

F I G. 18a
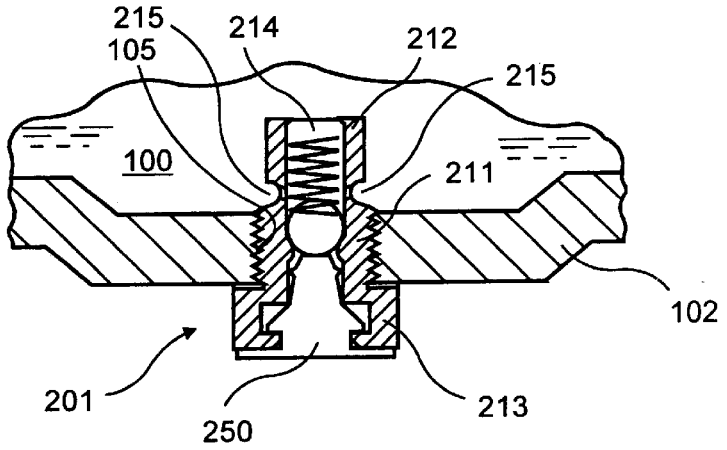
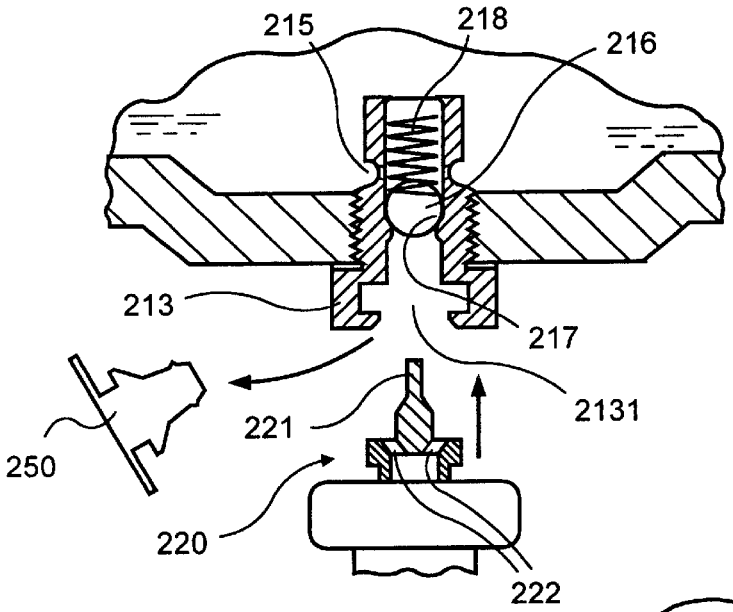
F I G. 18b
F I G. 18c
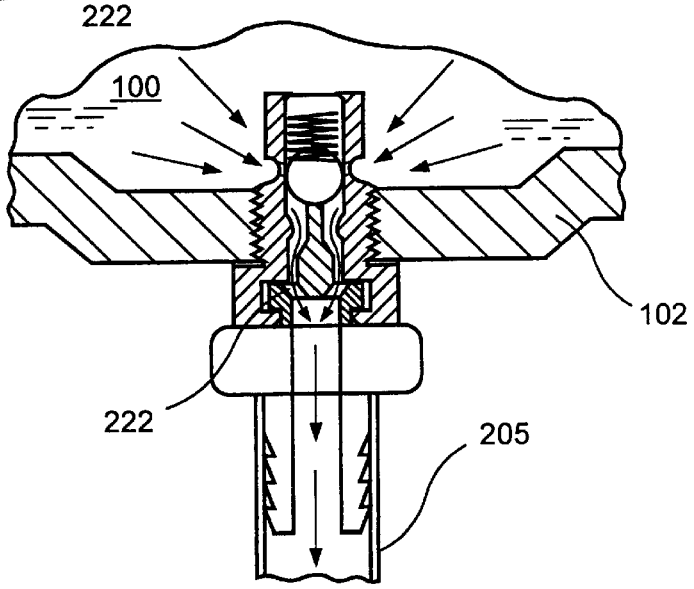

OIL DRAIN PLUG FOR OIL STORAGE VESSEL AND OIL DRAIN DEVICE USING SAME

TECHNICAL FIELD

The present invention relates to an oil drain plug (stopcock, drain cock) for use in oil storing vessels such as oil pans and gear boxes of automobiles or gear boxes of machines other than the automobiles, and to an oil drain device for the oil storing vessels using the oil drain plug.

BACKGROUND ART

Automobile engines for example have hitherto been provided with a mechanism for circulating a lubricant (oil) around predetermined parts to ensure a smooth motion of the moving portions, although the lubricating oil may degrade with use and with the elapse of time and lose its desired lubricating properties or may permit a mixing of abrasive powders or sludge into the oil. For this reason, used oil must be changed at a certain interval (commonly, at every travel through a certain distance of the order of 3000 to 5000 kilometers) from the viewpoint of preventing any damage of the engine body, etc.

FIG. 16 is a schematic diagram for explaining an example of a conventional typical engine having a structure for changing the used oil, in which oil 100 residing within an oil pan 102 provided below a crankcase is supplied to a predetermined region by means of an oil pump 101. The oil is delivered under pressure by the pump 101 and is pressure regulated by a regulating valve 103, after which it is cleaned off by removing, by a filter 104, metal powder, carbon, sludge or other foreign matters which have been mixed into the oil. After having lubricated the parts of the engine, the oil is returned to the oil pan 102. Incidentally, the oil pan 102 is typically structured to be filled with oil.

In this manner, the oil is subjected to the cleaning process for removing the mixed substance by the filter 104 in the course of its circulation, although the removal of the foreign matters by use of the filter is limitative, with the inevitable problem that the oil itself tends to have a degraded property with the elapse of time. Therefore, the oil is changed through the operations removing a stopcock (drain cock) 106 from a hole (drain hole) 105 which is provided in the bottom of the oil pan 102 but is usually stopped, to drain off the used oil through a natural oil drain, and then stopping the hole 105 to allow new oil to be fed from the top.

By the way, in the case of automobiles supplied by automobile manufacturers to the market, it is common for the oil drain hole 105 provided in the oil pan below the engine to be stopped with a simple threaded stopcock 106. For this reason, in the oil change operations, the stopcock 105 is removed from the oil drain hole 105 as described above at the beginning thereof and, after the oil drain, the stopcock is screwed thereinto, which operations are cumbersome, resulting inevitably in the workers covered with oil. In the case of service factories, etc., in which the automobiles are raised by a lift for the oil draining operation, the operation is relatively easy to perform, although the problem that the workers may be dirtied with oil can not be solved. Alternatively, in case of the execution without the lift, the workers must crawl into a narrow space below the automobile to remove the stopcock from the oil pan bottom or screw it thereinto, which operation is also extremely cumbersome.

As described hereinabove, the conventional oil changing operations have had a deficiency in its workability and posed a problem that the workers or environments may be dirtied with oil.

Thus, taken as measures for eliminating the operative deficiencies is an operation draining off the oil from the top of the engine. This includes for example a method in which an elongated suction tube is inserted into a mounting hole for an oil gauge provided for checking the amount or dirtiness of the engine oil, to thereby vacuum suck the used oil, or a method in which the suction tube is inserted through an oil supply port (these methods are hereinafter referred to as "top drain methods").

However, those top drain methods have no expedient for verifying that the tube extremity has reached the bottom of the oil pan since the tube is inserted from above a crankshaft or other complicated mechanism which is accommodated within a narrow space in a dense manner. It is therefore difficult to drain off all amount of the oil, which may incur a problem that the insufficient drain of the used oil is not recognized until an oil check is made after the supply of new oil, or in extreme cases, a problem that the oil changing operation must be made again. The top drain method is not necessarily prevailing with its deficiency that it is difficult to remove metal powders or the like deposited on the bottom of the oil pan.

On the other hand, the method of draining the used oil from the bottom is advantageous in that the drain of all amount of oil is feasible. Thus, there are proposed methods of eliminating the deficiency of dirtiness with oil while keeping the advantage of the bottom drain method. More specifically, proposed are an oil changing method using a permanently fixed plug with a built-in normally-closed poppet valve (U.S. Pat. No. 4,745,894 (Japanese Official Gazette corresponding thereto: Japanese Patent Pub. No. Hei4-48,987)) and an oil changing method using a permanently fixed plug with a built-in normally-closed ball valve (U.S. Pat. No. 5,048,578, Japanese Patent Laid-open Pub. No. Hei8-170,782).

These methods are described as follows by way of the case using the plug with a built-in ball valve for example. That is, as illustrated in FIGS. 17 and 18, an existing oil drain hole stopcock having a simple plug structure is removed, and instead, a valved plug (stopcock) 201 with a built-in normally-closed ball valve is secured to an oil drain hole 105. Then, upon the oil change, a dedicated jig 204 is fitted to the plug 201 with the normally-closed ball valve to open the ball valve so that oil 100 within the oil pan 102 is sucked by a negative pressure. After the completion of the drain, the jig 204 is removed to again close the ball valve so that the new oil 100 is filled thereinto. It is to be noted that the suction drain of the oil 100 upon the release of the ball valve is compulsorily made through an oil drain hose 205 by means of a suction device 206.

This method allows the suction drain of oil by use of the valved plug 201 to be performed through the switching between opening and closing of the valve, so that there is no need for the operation of the removal of the plug and for the operation of rescrewing. It is thus possible to simplify the operation by use of the dedicated jig 204 causing the opening or closing of the ball valve as well as to prevent the workers or environments to be dirtied with oil. Furthermore, since the plug can permanently be fixed, there is advantageously eliminated a possibility of collapsing the threads through the defective operations upon the screwing of the plug or the removal thereof.

Referring to FIG. 18, description is made of the detailed structure of the plug 201 with the ball valve and of the status of use of the same. That is, this plug 201 with the ball valve is of a cylindrical shape including a threaded stem 211 screwed into an oil drain hole (externally threaded hole) 105 of the oil pan 102 and including a spring receiving portion 212 projecting from the tip of the threaded stem 211, with the threaded stem 211 having at its rear end a screwing hexagonal bolt head 213 integral therewith. Note that the top of the spring receiving portion 212 is blocked by a plug 214 serving also as a spring support and that the circumferential wall of the base continuous with the threaded stem is formed with three radial holes 215 circumferentially apart from one another so as to ensure an inflow of the oil into the cylinder. Then, the interior of the cylinder of the threaded stem 211 is provided with a valve seat 217 which is stopped by a ball 216 so that a coiled spring 218 within the spring receiving portion 212 presses the ball 216 against the valve seat 217 to thereby normally close the valve portion (see FIG. 18(*a*)). It is to be appreciated that during the normal time, a protection cap 250 is fitted into an opening 2131 of the bolt head 213 to prevent a possible leakage of oil. On the contrary, in the event of releasing the ball valve, the protection valve 250 is removed, after which a ball pressing jig 220 (corresponding to the above dedicated jig 204) having a needle-type tip 221 is inserted through the opening 2131 of the bolt head 213 of the bolt member, to disengage the ball 216 from the valve seat 217 against the spring force of the coiled spring 218 to thereby open the flow passage (see FIG. 18(*b*) and (*c*)). The ball valve is released in this manner, with the result that as indicated by an arrow of FIG. 18(*c*), the oil 100 within the oil pan 102 is sucked from the radial holes 215 provided in the circumferential wall of the spring receiving portion 212 at its base, through the valve portion of the ball valve and the passage 222 provided in the ball pressing jig 220, and via the tube 205 into the suction device 206.

On the other hand, the plug with the built-in poppet valve described in the U.S. Pat. No. 4,745,849 corresponds to one having a valve head of a movable valve body in place of the ball valve of the above plug with the built-in ball valve. More specifically, the valved plug with the built-in poppet valve comprises a plug body which includes a cylindrical trunk portion extending through between the opposed ends and which is fixedly screwed into the oil pan, and a movable valve body which includes a valve head engaged with a valve seat which is the end of the plug body lying inside the oil pan, to close the valve passage, the movable valve body being urged by a spring force toward the direction closing the valve passage to normally close the valve passage.

Thus, in the same manner as the case of the plug with the built-in ball valve, the oil can be drained off by displacing the movable valve body against the spring force to open the valve passage.

The above-described bottom drain type oil changing method in which the conventional valved plug with the built-in ball valve or poppet valve is permanently secured to the oil drain hole will be advantageous over the other conventional methods in that the oil can promptly be drained from the oil pan with an easy operation and in that the metal powders or the like deposited on the bottom of the oil pan can be discharged.

However, the bottom drain type oil changing method using the valved plug with the built-in normally-closed valve having the above advantages suffers also from a problem to be improved in accordance with a recent change in the specifications of the oil pan. Furthermore, with a tendency toward a long-term use and long-traveling distance of the automobiles arising from the improvement in the automobile performances, it is desired to improve the durability of the valved stopcock and to ensure a secure drain irrespective of iteration of the used oil draining operations. It is also naturally expected to provide a low-cost plug capable of presenting the similar effect, and hence a plug having an even simpler structure is desired.

From the above points of view, the inventors have repeated wholehearted research and examination to conceive the present invention.

One of the above reasons of improvement lies in that although it was common in the prior art to fit the plug (stopcock, drain cock) for oil drain to the bottom of the oil pan 102, this structure may possibly break the drain plug in the event of contact (so-called "rubbing") of the bottom of the automobile with a projection on the ground. Thus, as shown in FIG. 19, recent tendency is toward the employment of a structure in which the plug 106 is fitted to the side wall (lateral wall surface) of the oil pan 102 in the vicinity of its bottom. In such a case, however, the oil to be drained off is limited to the oil residing above a line L of FIG. 19 due to the mounting position of the plug 106, with the result that the oil 110 or sludge may remain in the regions below the line L. In such a case, it may therefore be envisaged to insert a tube 111 from the top by the use of the top drain method as shown in FIG. 19 to perform the oil draining operation, although the top drain method entails the other problem described above. Furthermore, some types of automobiles may not permit the top drain method.

Another reason lies in a recent tendency toward a thinned wall of the oil pan from the viewpoint of the improvement in quality of materials, etc., even though there is employed a structure in which the drain cock is fitted to the bottom of the oil pan 102, which also poses a problem. That is, even the thinned oil pan requires a certain threaded hole length for fixedly screwing the drain cock, and hence backing materials 120 and 121 for the threaded hole are often fixed to the corresponding portions of the oil pan 102 as shown in FIG. 20 for example. However, even in the even to fusing the valved plug 201 proposed above, this will incur the same problem as described with reference to FIG. 19 since the line L in the diagram is the lower limit of the oil to be drained off as long as the plug is positioned in the bottom.

The present invention was conceived in order to further improve the prior art as described above. It is therefore an object of the present invention to provide a valved plug with a built-in normally-closed valve for an oil drain device, which ensures not merely an insertion of a flexible oil drain tube into the interior of an oil pan for a secure execution of the oil drain, but also a secure and smooth inserting operation without the tube being caught.

It is another object to provide a valved plug with a built-in normally-closed valve having an even simpler structure.

A further object of the present invention is to provide an oil drain device capable of securely draining off oil which may possibly remain on the bottom within an oil storing vessel such as an oil pan.

DISCLOSURE OF THE INVENTION

The above objects are achieved by the inventions of an oil drain plug for an oil storing vessel as defined in claims 1 to 5 and claim 6, as well as by the inventions of an oil drain device for an oil storing vessel as defined in claims 7 to 9.

The invention of the oil drain plug as defined in claim 1 is typically described through the application to the oil pan of automobiles. The invention of the oil drain plug defined in claim 1 is characterized in that the drain plug with a built-in normally-closed valve comprises a bolt member having at one end side thereof a threaded stem fixedly screwed into an oil drain hole of the oil storing vessel, having at the other end side thereof a head positioned outside of the oil storing vessel, having an oil drain passage axially through-formed and extending from the threaded stem at one end side to the head at the other end, and having a valve seat disposed in the oil drain passage at its end closer to the threaded stem; a movable valve body member having at one end thereof a valve body engaged with the valve seat of the bolt member to close a valve passage, the valve body being accommodated within the oil drain passage in such a manner that the valve body is movable toward the interior of the oil storing vessel from the state of engagement with the valve seat; and a spring member for normally closing a valve, the spring member being accommodated within the oil drain passage of the bolt member, the spring member generating a spring force for urging the movable valve body member toward a direction allowing the valve body to abut against the valve seat; the movable valve body member being moved toward the interior of the oil storing vessel against the spring force to disengage the valve body from the valve seat to thereby open the valve passage for draining off oil, wherein the head of the bolt member is provided with a mounting portion for a jig which moves the movable valve body member against the spring force to keep the valve passage open, and wherein the movable valve body member is formed with a guide surface for allowing the extremity of the oil suction tube inserted through an oil drain passage opening in the region of the head of the bolt member to be led into the interior of the oil storing vessel by way of the valve passage which is opened by the jig mounted thereto.

Although the above oil drain plug can be fitted to either the bottom surface or side wall surface of the oil storing vessel such as the oil pan, it is preferred in particular to fit it to the side wall of the oil storing vessel since the use of the oil suction tube ensures an easy and secure drain of the oil remaining on the bottom of the oil storing vessel. In the above construction, the oil drain passage provided in the bolt member in the form of a through-hole serves as a passage allowing, directly or indirectly via the movable valve body member, a pass of the flexible oil suction tube which is capable of easily bending, so that it is preferred to set as large a hole diameter as possible insofar as there is assured a structural strength required for the bolt member upon the screwing. The above spring means can be preferably but non-limitatively a coiled spring since it is desired to increase the moving stroke of the valve body member as much as possible to thereby maximize the gap upon the opening of the normally-closed valve which is defined by the valve body and the valve seat so as to ensure an easy pass of the tube therethrough.

The valve body provided on the movable valve body member can be typically and exemplarily one having an inverted conical shape engaged liquid-tightly with the valve seat at the circular opening of the bolt member, the valve body being mounted with a seal ring for oil seal engaged with the valve seat.

Furthermore, the guide surface provided on the movable valve body member serves to ensure a smooth and secure execution of the operation for leading the flexible oil suction tube through the opened valve passage formed between the valve seat and the valve body from the exterior into the interior of the oil storing vessel. The guide surface can be formed for example as an arcuate curved surface so as to allow the extremity of the tube inserted straightforwardly from the exterior to be gradually turned in the radial direction.

According to the present invention, the movable valve body member is provided with the guide surface for leading the oil suction tube into the interior of the oil storing vessel from the exterior thereof, so that the extremity of the tube can be smoothly inserted without the tube being caught. Thus, by the oil draining operation using this tube, the oil residing within the oil storing vessel can be drained down to the portion (bottom) below the plug mounting position, which was hitherto impossible to perform by the prior method.

Furthermore, the large-diameter opening circumferential edge of the through-hole opened at the tip of the threaded stem of the bolt member is intactly used as a valve seat, so that a larger valve diameter can be assured as compared with the case where the ball valve mechanism is provided within the cylinder as in the prior art. The valve body being seated on or disengaged from the large diameter valve seat, there can be set the gap defined relative to the valve seat by the stroke of the valve seat engagement portion being disengaged therefrom, so that a larger flow passage diameter for oil drain is assured upon the opening of the normally-closed valve, and hence a smooth oil draining operation is ensured even in the case of a high-viscosity oil.

The valve body can be in the form of a cone having a sufficiently larger diameter than the valve seat diameter so that there is ensured a stable engagement with the large diameter valve seat, whereby the posture of the valve body is stabilized upon the closing of the valve, allowing a secure valve opening or closing operation. Furthermore, by forming the outer diameter of the valve body member slightly smaller than the inner diameter of the small diameter portion of the bolt member, there can be prevented the axis of the valve body member from being off-centered.

The invention of claim 2 is characterized in that the movable valve body member of the above valve includes a one-end-open cylindrical trunk portion having the valve body at one end side thereof and opened at the other end thereof, an opening formed in the side surface of the trunk portion in the vicinity of the one end side, for allowing a passage in the interior of the cylinder to open to the exterior of the cylinder, and a guide surface for leading the extremity of the oil suction tube inserted from an opening at the other end side, via the interior of the cylinder and through an opening in the side surface of the trunk portion, into the interior of the oil storing vessel.

According to this invention, the flexible tube is inserted through the cylindrical trunk of the movable valve body member from the exterior of the oil storing vessel into the interior thereof, so that by forming the tube passage within the trunk portion so as to have an arcuate guide surface, there can be achieved a smooth guide of the tube extremity allowing a gradual turn in the radial direction. It is to be appreciated that the cylindrical trunk portion can be of any appropriate shape including a circular cylinder, an elliptical cylinder or rectangular cylinder but that it is preferred to employ a circular cylinder.

The invention of claim 3 is characterized in that the movable valve body member of the above plug includes an annular spring seat positioned within the oil drain passage of the bolt member in the region of the head, the spring seat being engaged by the urging spring, and a rod-like connecting shaft for connecting the spring seat and the valve body at the one end side, the connecting shaft being disposed at a position off-center relative to the longitudinal axis of the oil drain passage of the bolt member, to thereby form a section having a larger sectional area for the insertion of the oil suction tube in the region of its center, the connecting shaft having a side surface formed with a guide surface for guiding the insertion of the extremity of the oil suction tube.

Instead of forming the tube passage within the cylinder as in the invention of claim 2, the connecting shaft of this invention may be provided for example by cutting away a part of the cylindrical connecting shaft of the invention of claim 2 so that a larger diameter oil suction tube can be passed through the through-hole of the bolt member, but this is not limitative.

In addition to the function acquired in the invention of claim 1, this invention ensures a larger sectional area of the tube passage for the insertion of the oil suction tube.

This invention also achieves a smooth guide of the tube extremity allowing a gradual turn in the radial direction without the tube being caught, by virtue of the guide surface formed on the connecting shaft.

The invention of claim 4 is characterized in that in the above inventions, the movable valve body member is provided rotatably around its longitudinal axis, with an identification mark indicative of a posture around the longitudinal axis of the movable valve body member so that the direction of guide of the guide surface formed on the movable valve body member is adjustable around the longitudinal axis.

In order to enable the movable valve body member to rotate around the longitudinal axis in this construction, there may be formed a slot in the annular spring seat for example confronting the exterior of the movable valve body member so that a rotating jig is fitted to the slot for the rotation. Furthermore, the posture of the movable valve body member around the longitudinal axis can be recognized by the display of the direction of guide of the tube extremity using an identification sign including an arrow or a mark.

According to this invention, there can be regulated the direction in which the tube extremity is gradually turned, by virtue of the guide surface of the oil suction tube, thereby assuring a secure insertion of the tube extremity toward the bottom of the vessel.

The invention of the oil drain plug for the oil storing vessel defined in claim 5 is characterized in that it comprises a bolt member having at one end side thereof a threaded stem fixedly screwed into an oil drain hole of the oil storing vessel, having at the other end side thereof a head positioned outside of the oil storing vessel, having an oil drain passage axially through-formed and extending from the threaded stem at one end side to the head at the other end, and having a valve seat disposed in the oil drain passage at its end closer to the threaded stem; a movable valve body member having at one end thereof a valve body engaged with the valve seat of the bolt member to close a valve passage, the valve body being accommodated within the oil drain passage in such a manner that the valve body is movable toward the interior of the oil storing vessel from the state of engagement with the valve seat; and a spring member for normally closing a valve, the spring member being accommodated within the oil drain passage of the bolt member, the spring member generating a spring force for urging the movable valve body member toward a direction allowing the valve body to abut against the valve seat; the movable valve body member being moved toward the interior of the oil storing vessel against the spring force to disengage the valve body from the valve seat to thereby open the valve passage for draining off oil; wherein the movable valve body member includes an annular or bored disk-like spring seat positioned within the oil drain passage of the bolt member in the region of the head, the spring seat being engaged by the urging spring, and a solid-rod-like connecting shaft having a small diameter so as to form a large gap between the connecting shaft and the inner wall surface of the oil drain passage of the bolt, the connecting shaft serving to connect the spring seat and the valve body at the one end side.

According to this invention, there can be achieved a very simple construction of the structure of the valved plug with a built-in normally-closed opening/closing valve.

Although the plug of the above inventions is typically applied to the oil pan of the automobile, it is applicable to the oil storing vessel having a blocking plug for oil drain as well, which can be for example an automobile gear box or a gear box of machines other than automobiles.

The invention of the engine oil drain device as defined in claim 7 is characterized in that it comprises a combination of:

a) an oil drain plug with a built-in normally-closed valve for an oil storing vessel, the oil drain plug comprising a bolt member having at one end side thereof a threaded stem fixedly screwed into an oil drain hole of the oil storing vessel, having at the other end side thereof a head positioned outside of the oil storing vessel, having an oil drain passage axially through-formed and extending from the threaded stem at one end side to the head at the other end, and having a valve seat disposed in the oil drain passage at its end closer to the threaded stern; a movable valve body member having at one end thereof a valve body engaged with the valve seat of the bolt member to close a valve passage, the valve body being accommodated within the oil drain passage in such a manner that the valve body is movable toward the interior of the oil storing vessel from the state of engagement with the valve seat; and a spring member for normally closing a valve, the spring member being accommodated within the oil drain passage of the bolt member, the spring member generating a spring force for urging the movable valve body member toward a direction allowing the valve body to abut against the valve seat; the movable valve body member being moved toward the interior of the oil storing vessel against the spring force to disengage the valve body from the valve seat to thereby open the valve passage for draining off oil;

b) a valve body pressing jig fitted to the head of the bolt member of the oil drain plug, for keeping the movable valve body member in its valve open state against a spring force;

c) an oil suction hose removably fitted to the valve body pressing jig; and d) an oil suction tube whose extremity is inserted, through the oil drain plug with its valve passage opened, into the interior of the oil storing vessel.

The valve body pressing jig of the above construction is constructed as a structure having, to open the normally-closed valve, the engagement portion which is inserted from the bolt member head into the through-hole for the engagement with the movable valve body member and which moves (causes a stroke of) the movable valve body member toward the opened passage of the normally-closed valve (toward the inside of the vessel). In order to keep the normally-closed valve open by this valve body pressing jig, such a construction is preferably employed that the valve body pressing jig is retainably fitted to the head of the oil drain plug. For example, to keep the movable valve body member in a pressed and displaced state (posture) against the spring serving to normally close the valve, there can be used a bayonet mechanism which retains the relationship of engagement between the valve body pressing jig and the oil drain plug at a certain posture.

According to this invention, through a simple operation inserting into the head through-hole opening of the volt member the dedicated valve body pressing jig for pressing the annular spring seat provided at the end (rear end in the region of the bolt head) of the movable valve body member for example, the normally-closed valve (normally-closed type opening/closing valve) of the oil drain plug can be kept opened.

The oil suction tube of the above construction is typically and preferably made of a synthetic resin having a flexibility easy to bend, that is, allowing a downward bend of its extremity in a natural state. This tube may be inserted separately from the valve body pressing jig, or alternatively it may be previously fitted to the valve body pressing jig in a slidable manner so that after the movement of the valve body to open the valve portion, the flexible tube can be slid and inserted from the valve portion into the interior of the oil pan. In addition, the oil drain may be carried out only through that tube by means of the oil suction pump, or alternatively it may be performed both through the oil suction hose connected between the valve body pressing jig and the suction pump and through the oil suction tube extending through the interior of this oil suction hose.

According to the invention of this oil drain device, by performing an operation attaching the valve body pressing jig to the oil drain plug, almost all of the oil can be simply and compulsorily drained off in a short period of time by use of the suction means (oil suction hose and the associated suction pump) coupled to this valve body pressing jig. Furthermore, due to the flexibility possessed by the tube inserted to drain off the oil remaining on the bottom of the vessel, its insertion extremity can hang down onto the bottom surface of the oil pan so that the oil or sludge remaining on the bottom of the oil pan can be securely drained off by the suction through the oil suction tube even in the case where the oil drain plug is fitted to the side wall surface of the oil pan or even in the case of the oil pan having a structure in which a backing member is provided on the bottom surface of the oil pan for securing the threaded hole length.

The invention of claim 8 is characterized in that the oil drain plug for use in the invention of the above oil drain device comprises any one of the claims 1 to 5.

According to this invention, there is ensured an easy and secure operation for inserting the oil suction tube through the plug into the oil storing vessel, thus achieving a secure draining of all of the oil.

The invention of claim 9 is characterized in that in the invention defined in claim 7 or 8, the oil suction tube has an extremity provided with a female coupler, and that the valve body pressing jig and the oil suction tube are each provided with a male coupler to be mated with the female coupler.

According to this invention, there is ensured a simple execution of operation for removing the extremity of the oil suction hose from the valve body pressing jig for refitting it to the oil suction tube. With the oil suction hose coupled to the valve body pressing jig, almost all of the oil is drained off, after which the oil suction hose is removed from the valve body pressing jig for the refitting to the oil suction tube, thereby achieving the draining of the oil remaining on the vessel bottom by use of this tube. Thus, the oil suction hose can be used for these two operations.

BRIEF DESCRIPTION OF DRAWINGS

FIG. 5 is a diagram showing a detailed structure of an oil drain dedicated jig of the embodiment 1, in which (a) is a longitudinal sectional view and (b) is an external perspective view.

FIG. 6 is a diagram showing a valve body member of the embodiment 1, in which (a) is a longitudinal sectional view, (b) is an external perspective view and (c) is a diagram showing various sectional contours of a connecting shaft.

FIG. 18 is a diagram for explaining an oil draining operation in cases where use is made of a conventional oil drain plug with a built-in ball valve, in which (a) illustrates an ordinary time where the valve is closed, (b) is a diagram showing a state where an oil drain dedicated jig is fitted thereto, and (c) is a diagram showing a state where the oil drain dedicated jig is fitted thereto to perform an oil draining operation.

EXPLANATION OF REFERENCE NUMERALS

Figure 1:
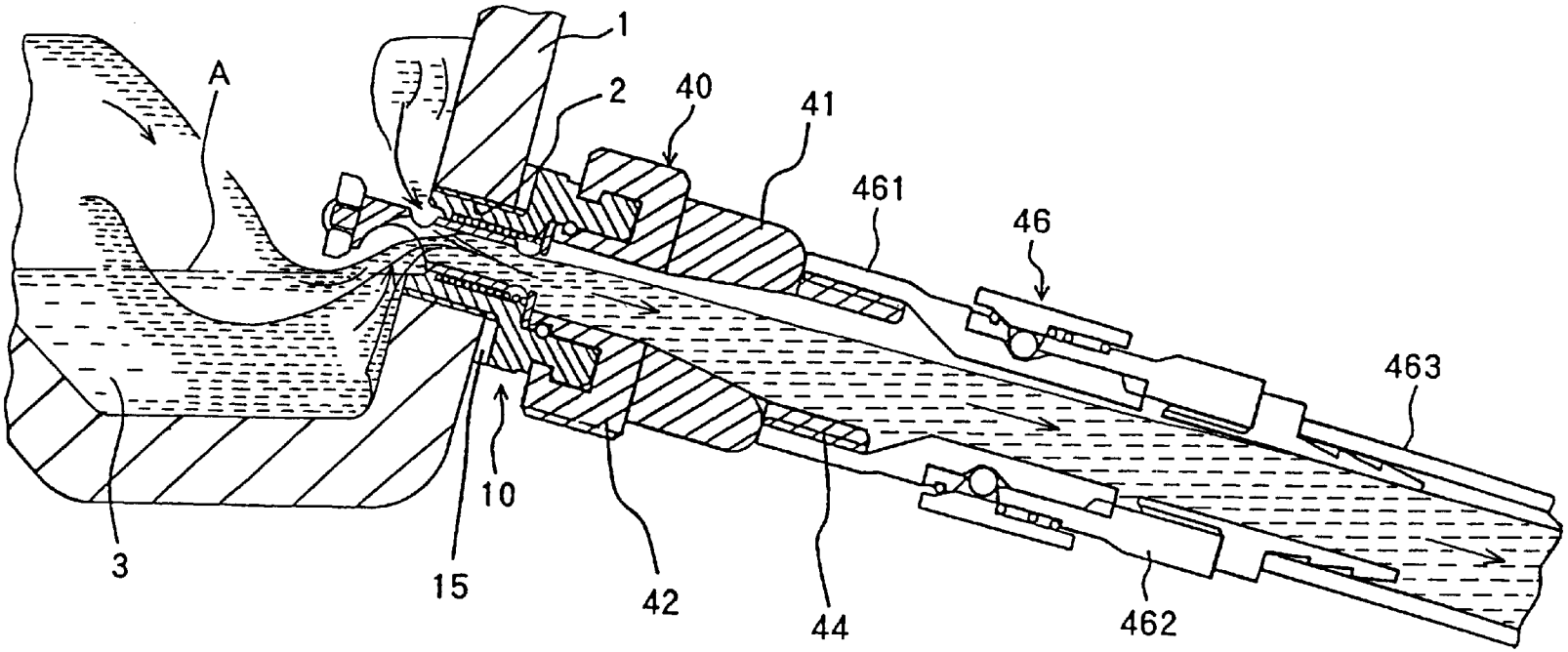
FIG. 1 is a longitudinal sectional view showing a state where an oil drain plug in accordance with an embodiment 1 of the present invention is secured to the side wall of the oil pan, with an oil suction hose linked to the plug to make up a one-touch coupler to perform an oil draining operation.

1 . . . oil pan
2 . . . oil drain hole
3 . . . oil
10, 10' . . . oil drain plug
11 . . . bolt member
12 . . . threaded stem
12*a* . . . valve seat (through-hole opening edge)
13 . . . head
14 . . . through-hole
14*a* . . . large-diameter portion
14*b* . . . small-diameter portion
15 . . . gasket
16 . . . mounting groove extending in the generatrix direction
17 . . . retainer groove (stop groove)
18 . . . cap fitting groove
20 . . . valve body member (movable valve body member)
20*a* . . . cylindrical trunk portion
20*b* . . . tube passage
20*c* . . . arcuate guide surface
21 . . . valve body
21*a* . . . thread portion
21*b* . . . weld portion
22 . . . open hole
22*a* . . . oil communication hole
23 . . . threaded rod
24 . . . spring seat (annular spring seat)
241 . . . through-hole
30, 30' . . . coiled spring
40 . . . oil drain adapter (adapter)
41 . . . operative portion
42 . . . connector portion
42*a* . . . crown-shaped portion
42*b* . . . locking flange
42*c* . . . valve body member engagement portion
42*d* . . . seal ring
43 . . . oil drain through-hole
44 . . . connecting thread portion
46 . . . coupler
461 . . . male coupler
462 . . . female coupler
463 . . . oil suction hose
464 . . . male coupler
4641 . . . female thread portion
4642 . . . disk
4643 . . . bolt
4644 . . . seal ring
50 . . . flexible oil drain tube
60 . . . rubber cap
60*a* . . . circumferential groove
61 . . . first seal ring portion
62 . . . second seal ring portion
63 . . . protective disk
64 . . . C-ring
70 . . . valve body member rotating jig
71 . . . protrusion
72 . . . spatula
73 . . . valve body member rotating jig
74 . . . rough surface (knurled surface)
80 . . . oil drain plug
81 . . . valve body member
82 . . . connecting shaft
83 . . . valve body
83*a* . . . thread portion
83*b* . . . weld portion
84 . . . annular spring seat
85 . . . tube passage
86 . . . threaded rod
87 . . . arcuate guide surface
88 . . . seal ring
100 . . . oil
101 . . . oil pump
102 . . . oil pan
103 . . . control valve
104 . . . filter
105 . . . oil drain hole
106 . . . drain plug (blocking plug)
111 . . . tube
120, 121 . . . backing member
201 . . . blocking plug
204 . . . jig (dedicated jig)
205 . . . tube
206 . . . suction device
211 . . . threaded stem
212 . . . spring receiving portion
213 . . . bolt head
2131 . . . opening
214 . . . plug
215 . . . hole
216 . . . ball
217 . . . valve seat
218 . . . coiled spring
220 . . . pressing jig
221 . . . extremity
222 . . . passage
250 . . . protection cap

BEST MODE FOR CARRYING OUT THE INVENTION

The present invention will now be described with reference to the drawings which illustrate examples in a non-limitative manner.

Embodiment 1

FIGS. 1 to 8 illustrate an example of application of an oil drain plug of the present invention in the case where an oil drain hole is provided in a side wall of an oil pan.

In FIG. 1, the oil pan is designated at 1, with 2 denoting the oil drain hole (internally threaded hole) which is provided in the side wall of this oil pan 1 and which is usually stopped by a simple blocking plug (see reference numeral 106 of FIG. 16) having no built-in normally-closed valve. In the case of use of the oil drain plug 10 of this embodiment, however, the blocking plug 106 is removed so that the oil drain plug 10 which will be described hereinbelow can be fixedly screwed into the hole. 3 denotes an oil stored in the oil pan 1.

Figure 4A:
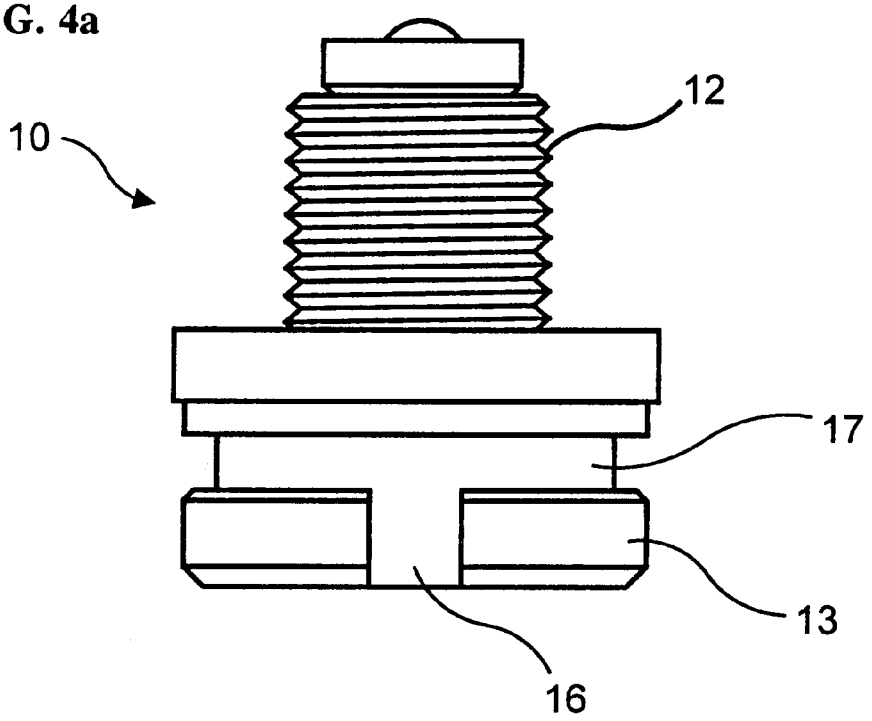
FIG. 4 is a diagram showing a detailed structure of the oil drain plug in accordance with the embodiment 1, in which (a) is a front elevational view and (b) is an general longitudinal sectional view.
Figure 4B:
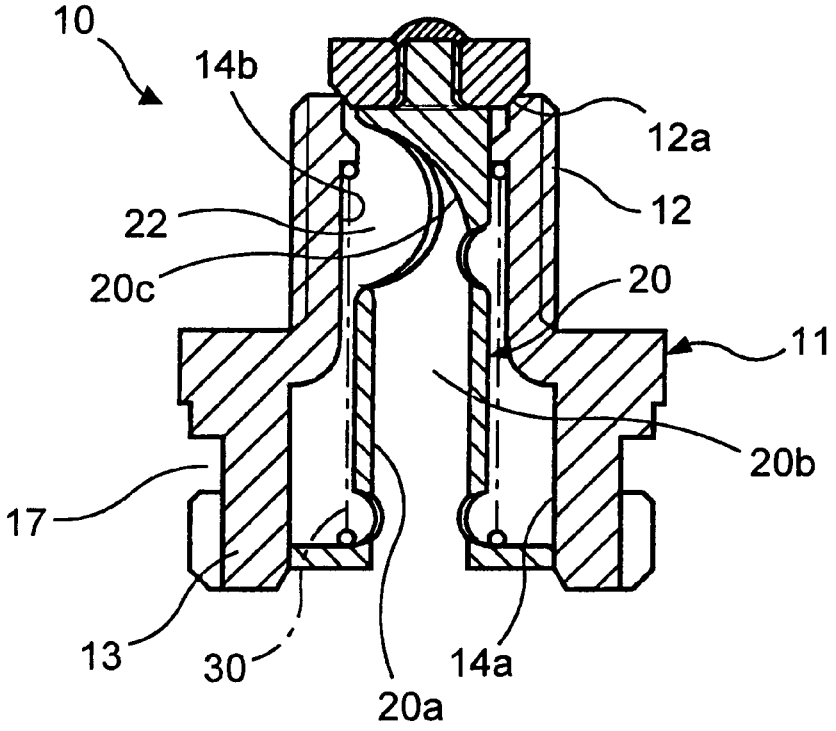

The details of the oil drain plug 10 of this embodiment are shown in FIG. 4. The oil drain plug 10 of this embodiment comprises a bolt member 11, a valve body member 20 and a coiled spring 30. The bolt member 11 includes an externally threaded stem 12 at its fore-end portion, a head 13 at its rear end portion continuous with the threaded stem 12 and having a larger diameter, and a stepped through-hole 14 (14*a*, 14*b*) (with a larger diameter step in the region of the bolt head) extending from the fore-end portion to the rear end portion. The valve body member 20 is inserted into the through-hole 14 (14*a*, 14*b*) of this bolt member.

In this embodiment shown in FIG. 1, the bolt member 11 is provided in such a manner that its threaded stem 12 is liquid-tightly screwed into the oil drain hole 2 of the oil pan 1, with the threaded stem 12 having a length equal to the sum of the thickness of the oil pan 1 and a gasket 15. The bolt head 13 in this embodiment is of substantially a circular section perpendicular to its longitudinal axis. The bolt head 13 is provided with a circumferentially extending stop groove 17 for a rubber cap (or a metal cap) 60 which will be described later. The bolt head 13 is further provided with a mounting groove 16 extending in the generatrix direction for use in mounting a valve body pressing jig 40 dedicated to the oil drain (hereinafter, referred to as an oil drain adapter or simply as an adapter) which will be described later. Note that the stop groove 17 serves also as a retainer groove for retaining the adapter 40 in the mounted state and that the following description is made of the retainer groove 17.

Figure 2:
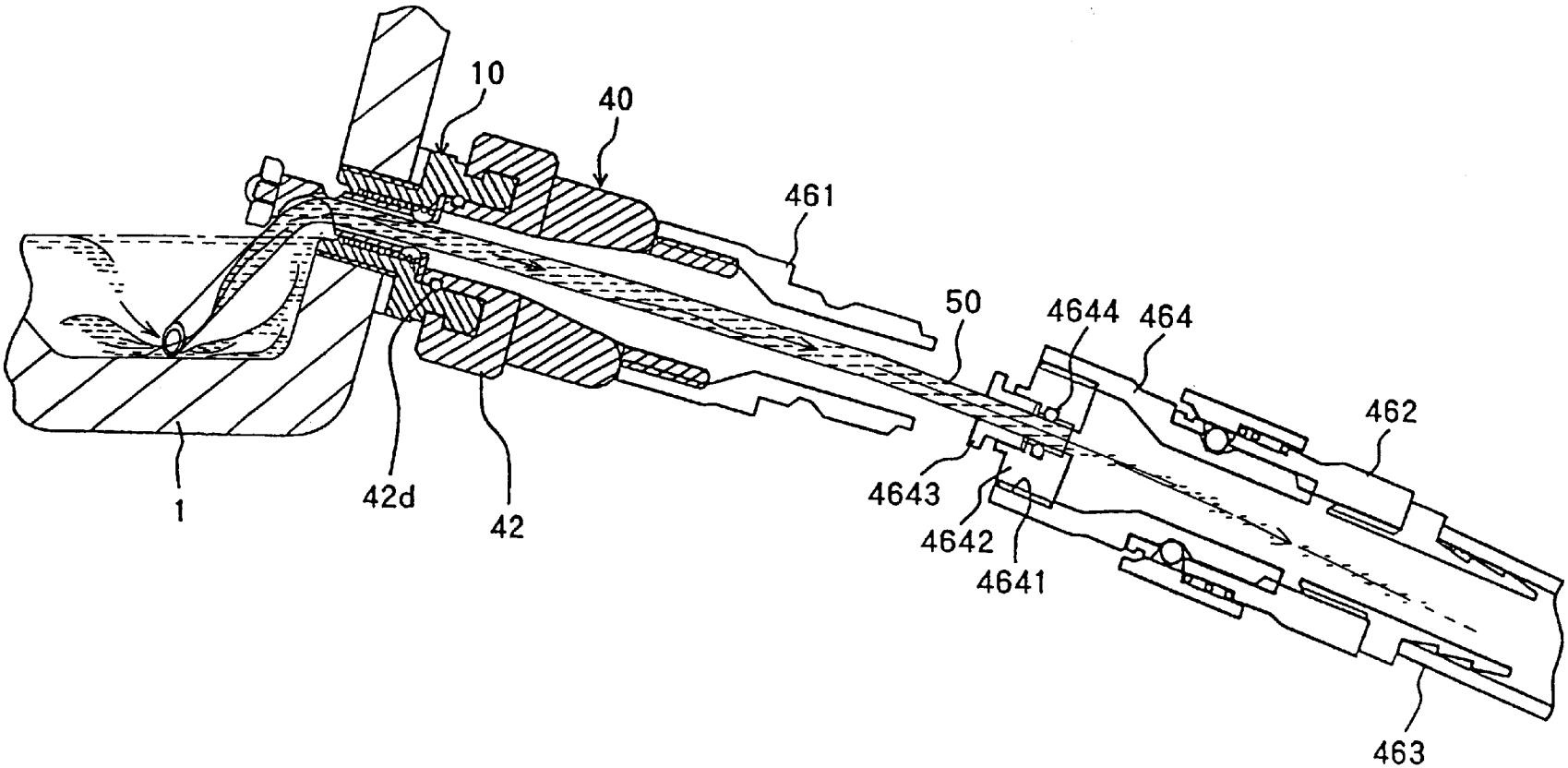
FIG. 2 is a longitudinal sectional view showing a state where an oil suction tube is fitted to the one-touch coupler of FIG. 1 to perform an oil draining operation.
Figure 3:
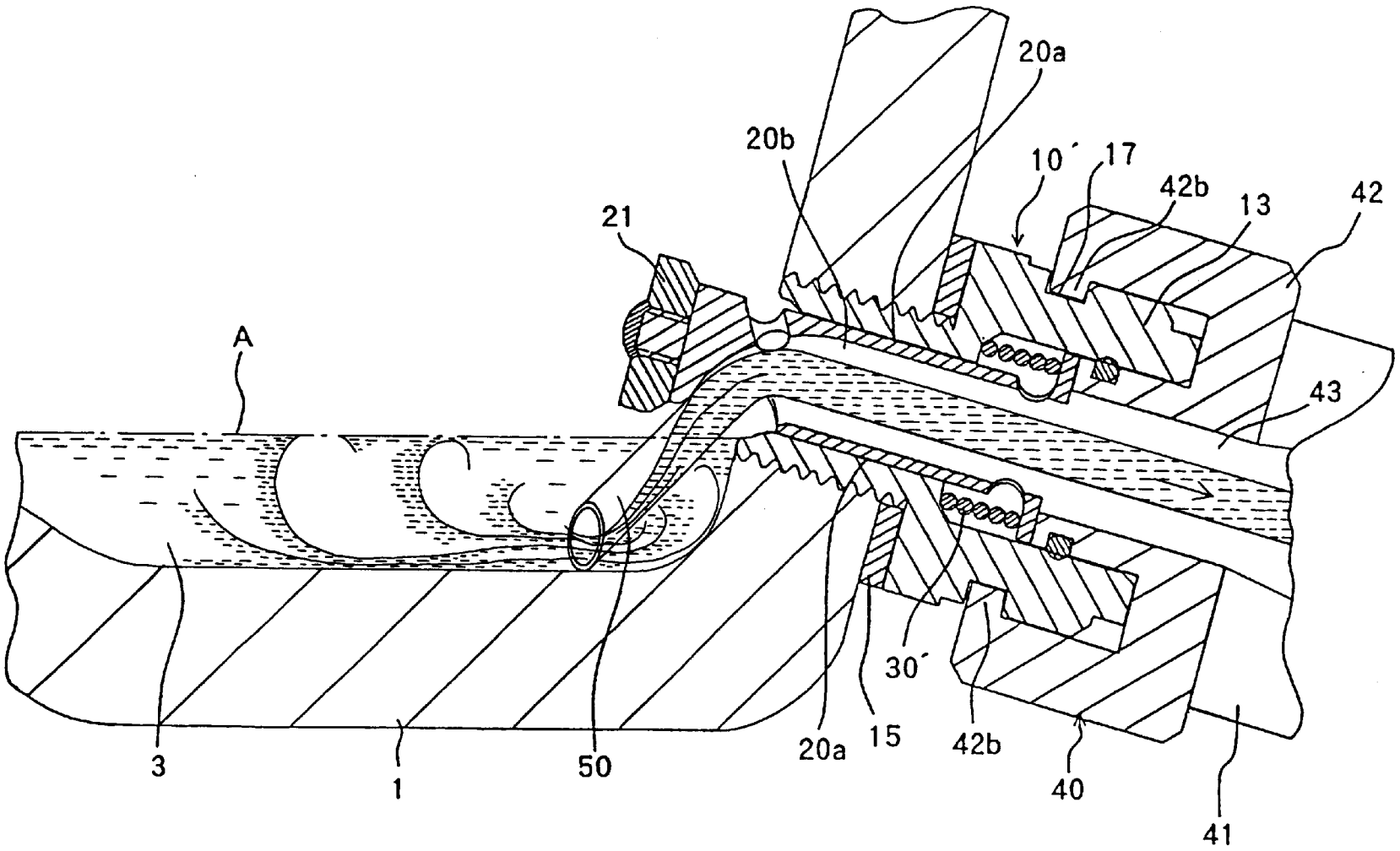
FIG. 3 is a partly enlarged view of a construction of the plug including a bolt member, a valve body member and a coil spring, which construction is slightly different from FIGS. 1 and 2.

The bolt member 10 of FIGS. 1 and 2 is different from a bolt member 10' of FIG. 3 in that the coil spring 30 of the former (FIGS. 1 and 2) extends from the stepped large-diameter portion up to the small-diameter portion whereas a coil spring 301 of the latter (FIG. 3) extends only within the stepped large-diameter portion, although the other constructions are the same. The former construction has an advantage in that a larger valve travel of the valve body relative to the valve seat is assured due to the elongated coil spring 30 ensuring a larger compression length, whereas the latter construction is advantageous in that the guide of the axial movement of the valve body member can be effected in a more secure and stable manner without off-centered condition by causing the small-diameter portion of the bolt member to approximately coincide in dimensions with the outer diameter of the valve body member.

As illustrated in (a) and (b) of FIG. 4 as well as (1) and (b) of FIG. 6, the movable valve body member (hereinafter, referred to as the valve body member) 20 of this embodiment includes a cylindrical trunk portion 20*a* having a threaded rod 23 projecting from the extremity (upper end of FIG. 6(*a*)) of the trunk portion 20*a*, and a cone-shaped valve body 21 having a thread portion (female thread) 21*a* which is screwed onto the threaded rod 23 in an inverted manner so that the valve body 21 becomes integral with the trunk portion 20*a*. The flared base portion of the conical valve body 21 is designed to have a larger diameter than that of a valve seat 12*a* defined by the opening edge of the through-hole of the threaded stem 12 of the bolt member 10 so that the opening is closed in a liquid-tight manner by allowing the valve body 21 to abut against the valve seat 12*a*. In the vicinity of its extremity, the cylindrical truck portion 20*a* of the valve body member 20 is provided with an arcuate surface 20*c* and an open hole 22 such that a tube passage 20*b* extends from the interior of the cylinder in a radially and continuously curved manner so as to open to the exterior of the cylinder. At its rear end (lower end of FIG. 6(*a*)), the cylindrical trunk portion 20*a* has an outwardly extending flange which forms an annular spring seat 24 for the coiled spring 30. Reference numeral 21*b* denotes a weld portion at the through-tip of the threaded rod 23 which is thorougly screwed into the valve body 21, the weld portion 21*b* serving to firmly integrate the threaded rod 23 with the valve body 21 to thereby completely prevent any oil leakage.

Reference numeral 22*a* denotes a small oil flow passage formed in the cylindrical trunk portion so as to permit inflow of the oil into the tube passage 20*b*. Although the oil flow passage 22*a* is solely visible in the diagram, a plurality of oil flow passages 22*a* may be provided. In addition to the circular section, the cylindrical trunk portion 20*a* of this embodiment may have any appropriate sections perpendicular to the longitudinal axis as shown in FIG. 6(*c*). In other words, the section is not limited to any particular shape as long as it allows a formation of the tube passage therewithin which accommodates an oil suction tube 50 which will be described later and as long as it allows a formation of the arcuate guide surface 20*c* and the open hole 22.

The coil spring 30 is accommodated in the through-hole 14 (14*a*, 14*b*) of the bolt member 11 and has one end engaged with a stepped shoulder portion of the through-hole 14*b* and the other end engaged with the spring seat 24 of the valve body member 20, thereby allowing a spring force toward the bolt member head 13 to act on the valve body member 20, to normally cause the valve body 21 to be seated on the valve seat 12*a*, to thereby normally close the opening/closing valve (see FIG. 4(*b*)).

According to the oil drain plug 10 of this embodiment having the above construction, at the normal time (FIG. 4(*b*)), the valve body member 20 is biased toward the bolt head 13 by a spring force of the coiled spring 30, with the result that the valve body 21 is seated on the valve seat 12*a* so that the valve portion is kept closed at all times.

Then, when the adapter 40 is inserted through the opening in the bolt head 13 and the valve body member 20 is forced toward the threaded stem 12, the valve body member 20 compresses the coiled spring 30 to displace it toward the threaded stem 12 so that the valve body 21 is disengaged from the valve seat 12*a* to open the normally-closed valve. Accordingly, as shown in FIG. 1, the oil residing in the threaded stem (i.e., in the oil pan) flows from the opened opening/closing valve through the open hole 22 of the valve body member 22 or through the oil flow passage 22*a*, and is drained to the exterior through the opening in the spring seat 24 of the valve body member 20.

Description will then be made of the oil drain adapter 40 which is used to open the opening/closing valve of the oil drain plug 10 for the drain of oil.

The oil drain adapter 40 of this embodiment is shown in FIGS. 1 to 3 and FIG. 5 and comprises a connector portion 42 disposed at the extremity of a hexagonal nut type operative portion 41. The connector portion 42 includes a crown-shaped (annular) portion 42*a* having a recess into which is fitted the bolt head 13 of the oil drain plug 10, and a pair of short locking flange 42*b* arranged in an opposed and inwardly projecting manner at the extremity of the crown-shaped portion 42*a*. The connector portion 42 further includes a valve body engagement portion 42*c* which axially slightly projects from the bottom of the crown-shaped portion 42*a* and is inserted into the through-hole large-diameter portion 14*a* from the exterior of the head 13 of the bolt member 11, to thereby engage with the spring seat 24 of the valve body member 20. Incidentally, reference numeral 42*d* denotes a seal ring which is secured to the outer periphery of the valve body engagement portion 42*c* and which resiliently attaches to the inner periphery of the through-hole large-diameter portion 14*a* when the valve body engagement portion 42*c* is fitted into the through-hole large-diameter portion 14*a* of the bolt member 11.

Reference numeral 43 denotes an oil drain through-hole which extends from the connector portion 42 at one end of the adapter 40 up to the other end. 44 denotes a connecting thread portion for connecting a male coupler (see FIG. 1) making up a coupler 46 used when the oil is compulsorily drained by a negative pressure suction.

The oil drain adapter 40 of this embodiment is used as follows. That is, as shown in FIG. 3, the connector portion 42 is inserted into the bolt member 11 along the longitudinal axis, with its locking flanges 42*b* being engaged with the mounting groove 16 in the generatrix direction of the bolt member 11. Initially, this inserting operation is not particularly subjected to a resistance, although when the insertion reaches a certain amount, the valve body engagement portion 42*c* engages with the spring seat 24 of the valve body member 20 so that the spring force of the coiled spring 30 results in a resistance against the insertion. Against this spring force, the connector portion 42 is further forced thereinto until the locking flanges 42*b* reach the position of the circumferentially extending retainer groove 17 continuous at right angle with the mounting groove 16 in the generatrix direction. At that time, the connector portion 42 is rotated around its longitudinal axis to allow the locking flanges 42*b* to be fitted into the retainer groove 17. As a result of this, the spring force of the coiled spring 30 forcing back the connector portion 42 is earthed by the engagement of the retainer groove 17 with the locking flanges 42*b* fitted thereinto so that the connector portion is retained with this state. In the state where this connector portion 42 is retained by the bolt member 11, the valve body member 20 is displaced or urged toward the threaded stem 12 against the spring force of the coiled spring 30 so that the valve body 21 is disengaged from the valve seat 12*a* to open the normally-closed valve, with the result that the oil residing in the oil pan 1 can be drained through the oil drain passage formed by these elements (the oil drain plug 10 and the adapter 40). It is to be appreciated that the oil is prevented from leaking through the other portions than the above oil drain passage at that time since the seal ring 42*d* secured to the valve body engagement portion 42*c* resiliently attaches to the inner periphery of the through-hole large-diameter portion 14*a* of the bolt member 11.

FIG. 1 illustrates a state where a male coupler 461 of the coupler 46 is linked to the adapter 40 for use, with the male coupler 461 being fitted into and mated with a female coupler 462 at the end of an oil suction hose 463 connected to an oil suction pump not shown to thereby compulsorily suck the oil. Note that the above coupler can be a known coupling jig.

Reference numeral 50 denotes an oil suction tube which can be a flexible tube made of e.g., synthetic resin. From the end opening of the male coupler 461 linked to the oil drain adapter 40, the oil suction tube 50 is inserted through the tube passage 20*b* of the valve body member 20 and via the opened normally-closed valve into the interior of the oil pan 1 for the purpose of draining the oil remaining on the bottom of the oil pan 1.

In this embodiment, the oil suction tube 50, as shown in FIG. 2, is secured to another male coupler 464 which is prepared to be fitted into and mated with the female coupler 462 of the coupler 46, by means of a disk 4642 screwed into its female thread portion 4641. Reference numeral 4643 denotes a bolt which is screwed into the disk 4642 in order to secure the end (rear end) of the tube 50 to the disk 4642. Reference numeral 4644 denotes a seal ring. This allows the male coupler 464 to previously have a structure in which the tube 50 is fitted thereto with its rear end leading to the interior of the male coupler 464, and with its free fore end. FIG. 2 illustrates the male coupler 464 being fitted into and mated with the female coupler 462.

Figure 7A:
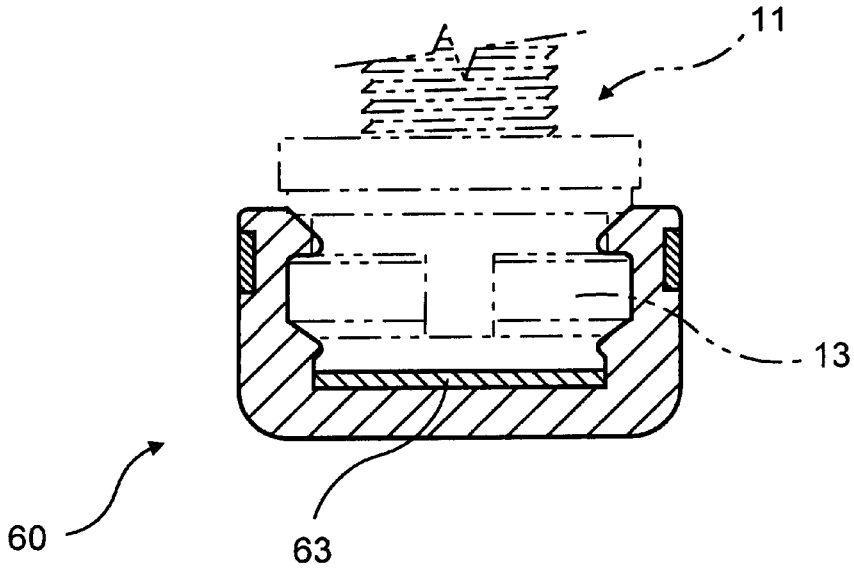
FIG. 7 is a diagram for explaining a cap which is fitted onto the oil drain plug of the embodiment 1 during the ordinary time, in which (a) is a longitudinal sectional view showing a process of fitting the cap to the bolt member head, (b) is a longitudinal sectional view of the cap and (c) is a perspective view of a C-ring.
Figure 7B:
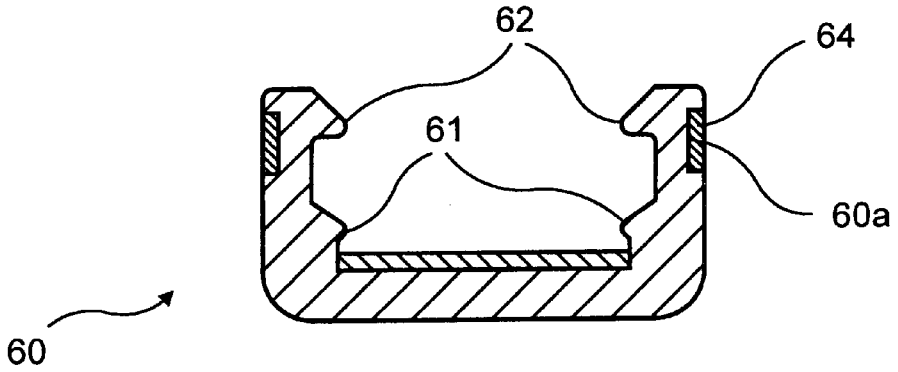
Figure 7C:
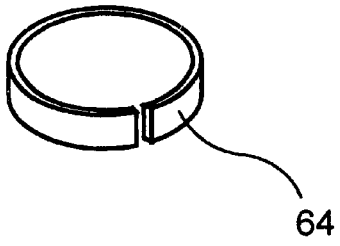

FIG. 7 illustrates the rubber cap 60 fitted to the oil drain plug 10 after the removal of the dedicated adapter 40. The rubber cap 60 is in the form of a bottomed cylinder having one open end, which is fitted to the bolt head 13 of the bolt member 11. The rubber cap 60 includes a first seal ring portion 61 resiliently attaching to the end surface of the head of the bolt member 11, and a second seal ring portion 62 resiliently attaching to the locking groove 17 of the bolt member 11 to prevent the cap 60 from coming off, with the bottom fitted with a protective disk 63 made of iron so that the cap 60 fitted to the head 13 of the bolt member 11 can prevent any possible oil leakage and intrusion of dusts or the like into the bolt head. In order to prevent the cap 60 from coming off, the outer periphery of the cap 60 is formed with a circumferential groove 60*a* into which a C-ring 64 is resiliently fitted as shown in FIG. 7(*c*).

Referring to FIGS. 1 to 3, description is then made of a mode of use of the oil drain plug of this embodiment which has been described hereinabove as well as a mode of use of an oil drain device using the same.

Figure 16:
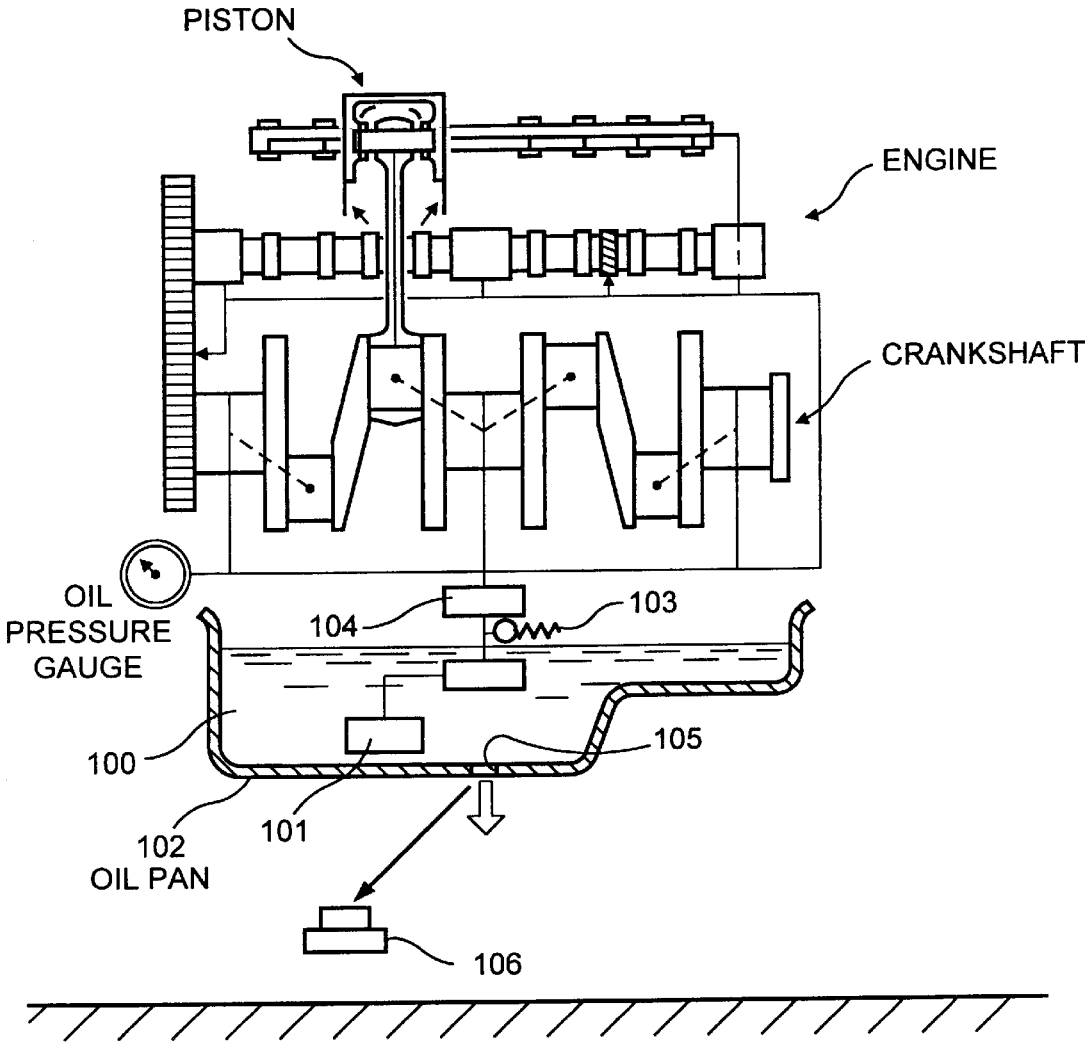
FIG. 16 is a diagram for explaining an example of a conventional method for draining oil from the oil pan of an engine to which the present invention is applied.
Figure 17:
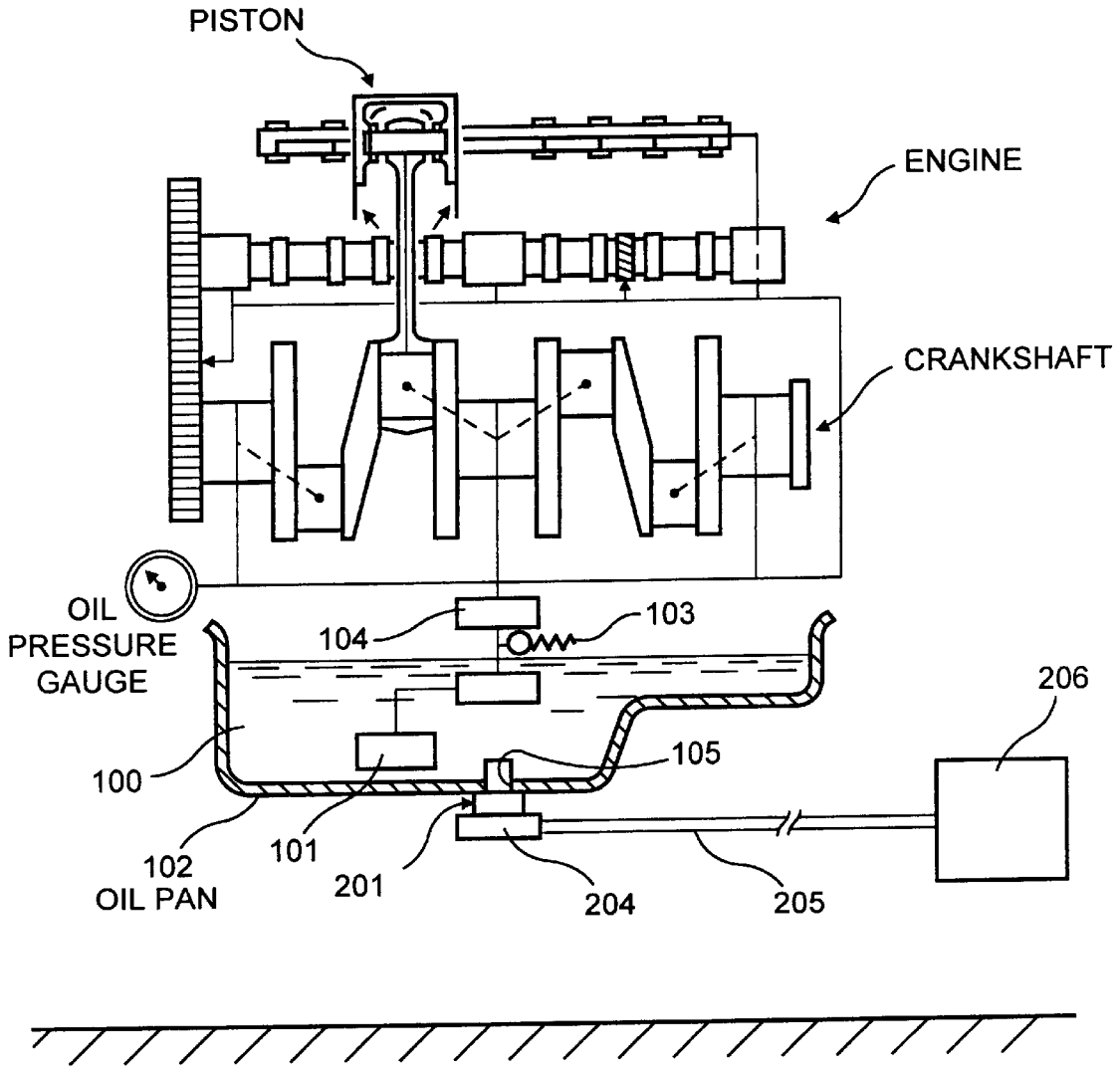
FIG. 17 is a diagram for explaining another conventional method for draining oil from the oil pan of the engine to which the present invention is applied.
Figure 19:
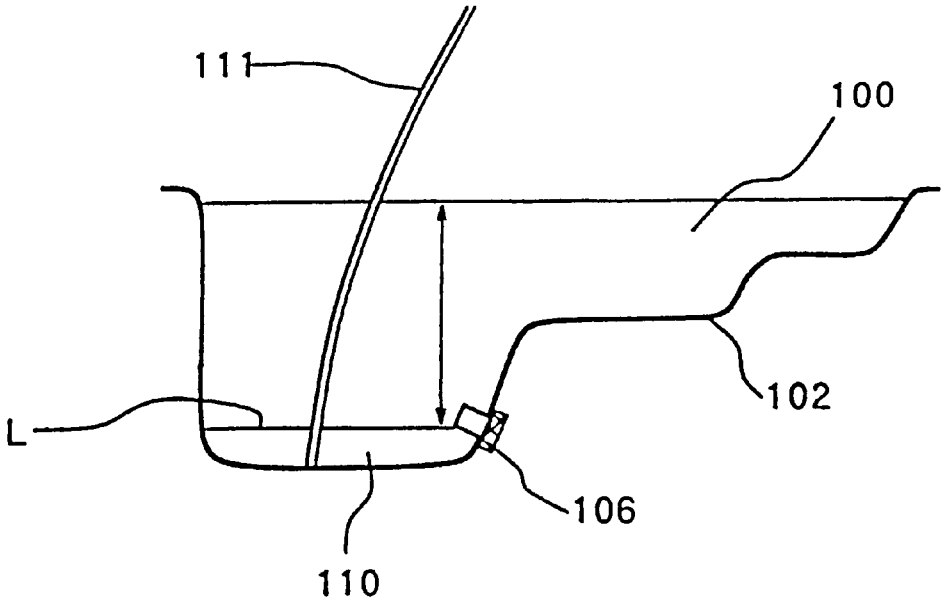
FIG. 19 is a diagram for explaining a problem which may occur when the oil drain plug is secured to the side wall of the conventional oil pan.
Figure 20:
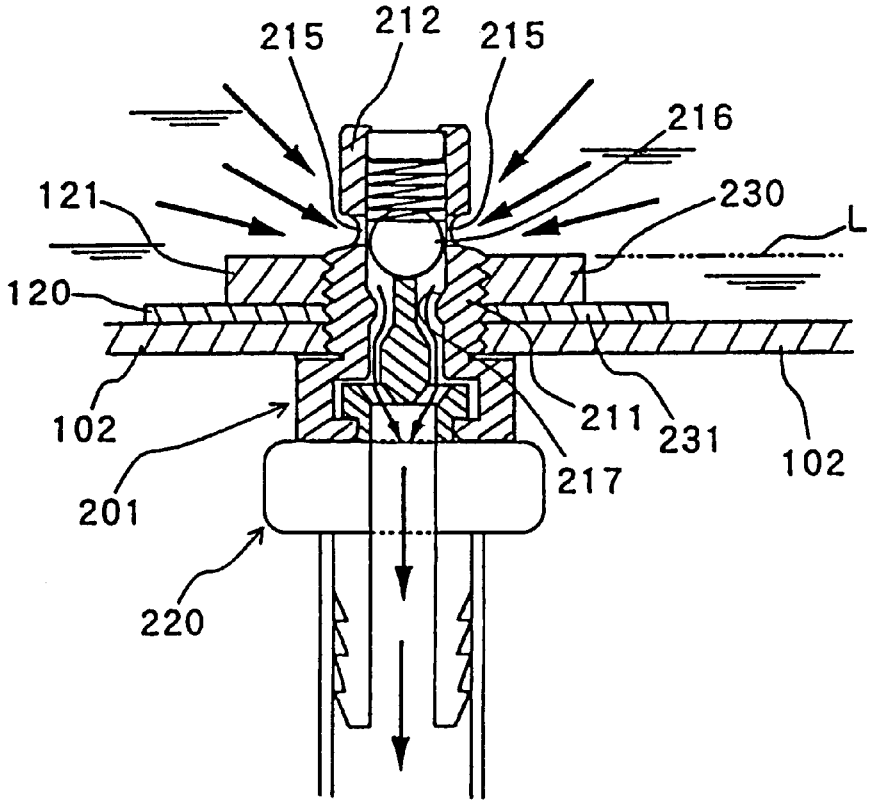
FIG. 20 is a diagram for explaining a problem which may occur when the oil drain plug is secured to the bottom of the conventional oil pan.

In cases where the simple blocking plug 106 is fixedly screwed into the oil drain hole 2 of the oil pan 1, as illustrated in FIGS. 16 and 18, the blocking plug 106 is first removed to execute a predetermined oil draining operation, after which a screwing jig (not shown) is used to threadedly secure the oil drain plug 10 of this embodiment to the oil drain hole 2 so that a new oil is filled into the oil pan.

As has been illustrated with reference to FIG. 4 and other diagrams, the threadedly secured oil drain plug 10 prevents the oil from draining off in the normal state since the valve body 21 of the valve body member 20 is seated on the valve seat 12*a* with the aid of the spring force of the coiled spring 30 to always close the opening/closing valve.

Subsequently, the oil draining operation can be performed with the oil drain plug 10 fixed.

More specifically, in the state where the oil drain plug 10 has already been fixed, the cap 60 is first removed from the bolt member 11 and the locking flanges 42*b* of the oil drain adapter 40 are engaged with the mounting groove 16 in the generatrix direction for the bolt member 11 so that the connector portion 42 is axially inserted into the bolt member 11. Once the locking flanges 42*b* reach the position of the circumferential retainer groove 17 continuous at right angle with the mounting groove 16 in the generatrix direction, the connector portion 42 is rotated around its longitudinal axis so that the locking flanges 42*b* are fitted into the retainer groove 17 to retain the connector portion 42.

As a result of this, the valve body 21 is disengaged from the valve seat 12*a* to open the opening/closing valve so that in the case of FIG. 1, the oil residing within the oil pan 1 is compulsorily drained by a negative pressure suction through the oil drain plug 10 and the through-hole 43 of the oil drain adapter 40. That is, the rear end of the male coupler 461 previously linked to the adapter 40 is fitted into the female coupler 462 of the one-touch coupler 46 so that the oil is sucked from this one-touch coupler 46 through the oil suction hose 463 by a negative pressure by means of the suction pump. This enables the oil drain operation to be performed without leaking any oil around the periphery.

Then, at the time when there has occurred an interruption of the drain of the oil 3 from the interior of the oil pan 1, an operation is carried out for draining the oil remaining in the portion below the position indicated by a line A of FIGS. 1 to 3.

More specifically, the female coupler 462 is first disengaged from the male coupler 461, and then the another male coupler 464 previously fitted with the tube 50 is fitted into and mated with the female coupler 462. Then, from the rear end opening of the male coupler 461 linked to the adapter 40, the free end of the tube 50 is inserted through the open hole 22 of the valve body member 20 into the interior of the oil pan 1 (see FIG. 2). As a result of this, the extremity of the flexible tube 50 is allowed to naturally curve and hang down to abut against the bottom of the oil pan 1. Then, the remaining oil can be drained off by negative pressure suction by means of the suction pump (not shown) through the suction hose 463 connected via the coupler 46 to the rear end of the tube 50.

After the completion of the above operations, the tube is withdrawn and, in the reverse procedure to the above, the oil drain adapter 40 is removed from the head 13 of the bolt member 11 of the oil drain plug 10. With this removal of the adapter 40, the valve body 21 of the oil drain plug 10 is seated on the valve seat 12*a* to return the normally-closed valve into the closed state, preventing any oil leakage in spite of filling-up of new oil. Afterward, the cap 60 is fitted to the head of the bolt member of the oil drain plug 10.

In cases where the oil is drained off by a negative pressure suction as set forth hereinabove, the oil drain plug 10 of this embodiment or the oil drain device using this oil drain plug 10 (the device using the oil drain adapter 40 and others) can have a large-diameter oil drain passage, with the widely openable opening/closing valve, thus eliminating any possibility of incurring the inconvenience that sludge or the like may clog the passage and valve. Furthermore, due to the stable motion of the valve body member 20 axially moving relative to the bolt member 11, there can be achieved a secure opened or closed state of the opening/closing valve, in particular, a secure normally-closed state of the opening/closing valve, with no fear of incurring defective sealing since the valve body is by no means damaged. In view of its capability to cancel the deficiency of oil leakage which may be fatal for the automobile engine, its advantage will be significant.

As compared with the conventional type incorporating a ball valve within the through-hole of the bolt member fixedly screwed into the oil drain hole of the oil pan, this embodiment set forth in this manner can be implemented by the structure proposed by the present invention using the edge of the above through-hole as the valve seat and having the capability of setting the stroke for the disengagement of the valve body seated on the valve seat substantially independently of the structure of the oil drain plug.

Furthermore, by draining the oil remaining on the bottom by the insertion of the oil drain tube 50, there can be securely performed a discharge of oil and sludge unwillingly remaining on the bottom of the oil pan 1, which could not been expected with the conventional device. Thus, its advantage will be remarkable.

This embodiment could further employ the following construction. That is, as shown in FIG. 6(*b*), two small through-holes 241, 241 are formed at positions circumferentially apart from each other on the spring seat 24 of the valve body member 20, and the reverse side (externally visible surface) of the spring seat 24 bears an arrow (not shown) indicative of the direction (the posture of rotation around the longitudinal axis of the valve body member 20). Furthermore, as shown in FIG. 8, a valve body member rotating jig 70 is prepared which has a pair of protrusions 71, 71 capable of mating with the through-holes 241, 241, and the jig 70 is used to rotate the valve body member 20 around the longitudinal axis.

Then, upon the removal of the cap 60, as needed, the pair of protrusions 71, 71 of the valve body member rotating jig 70 are mated with the through-holes 241, 241 of the valve body member 20 to perform the operation for rotating the valve body member 20, allowing the opening hole 22 to have the posture shown in FIGS. 1 to 3. This allows the oil suction tube 50 to securely abut against the bottom of the oil pan 1.

Figure 8A:
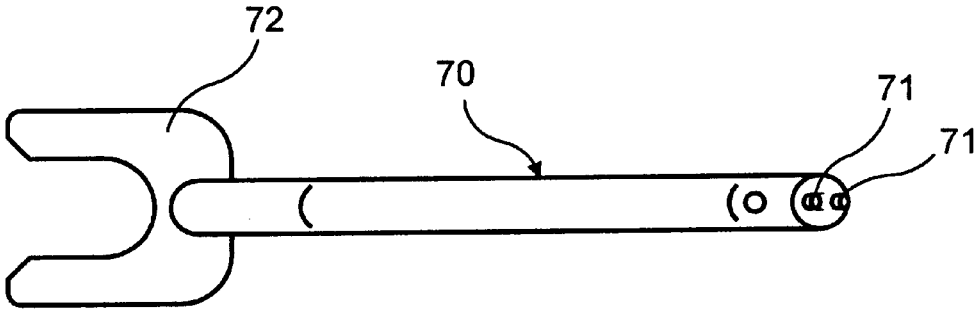
FIG. 8 is a diagram showing a valve body member rotating jig of the embodiment 1, in which (a) is a top plan view, (b) is a front elevational view and (c) is a front elevational view showing another example of the valve body member rotating jig.
Figure 8B:
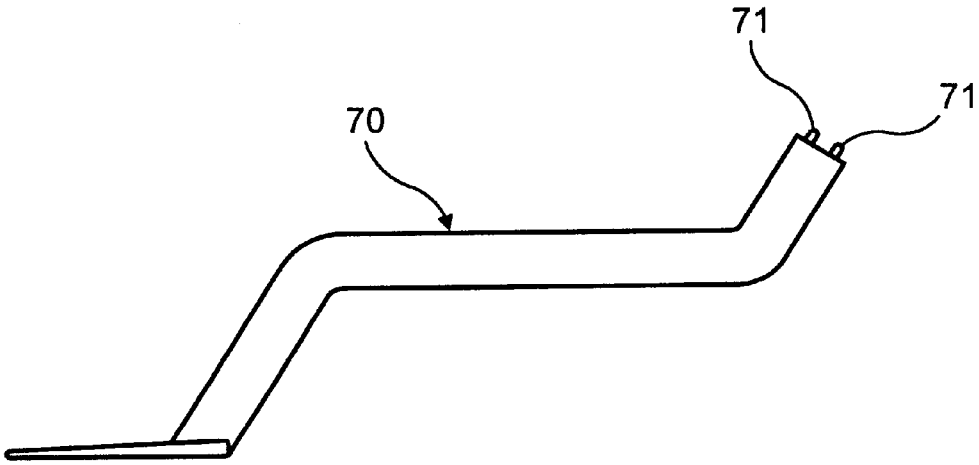
Figure 8C:
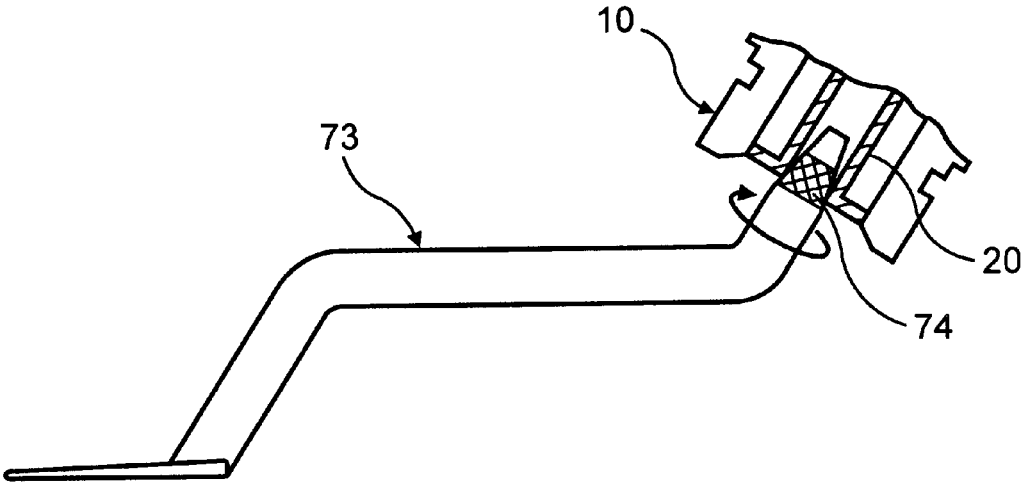

It is to be appreciated that the valve body member rotating jig 70 as shown in FIG. 8 has not only the pair of protrusions 71, 71 formed at one end of a crank shaped bent rod member but also a forked spatula 72 for removing the cap 60 formed at the other end thereof so that a single jig can advantageously be used for both the removal of the cap 60 and the rotation of the valve body member.

FIG. 8(*c*) illustrates a valve body member rotating jig 73 different from the above, having at its tip a rough surface (knurled surface or the like) in the form of a taper which is fitted into the bottom opening (opening in the region of the external end) of the valve body member 13, whereby the posture of the valve body member can be controlled to a predetermined orientation in the same manner as the above. According to this embodiment, there is no risk that the thin pins as the pair of protrusions 71, 71 of FIG. 8(*a*) may break.

Embodiment 2

Figure 9:
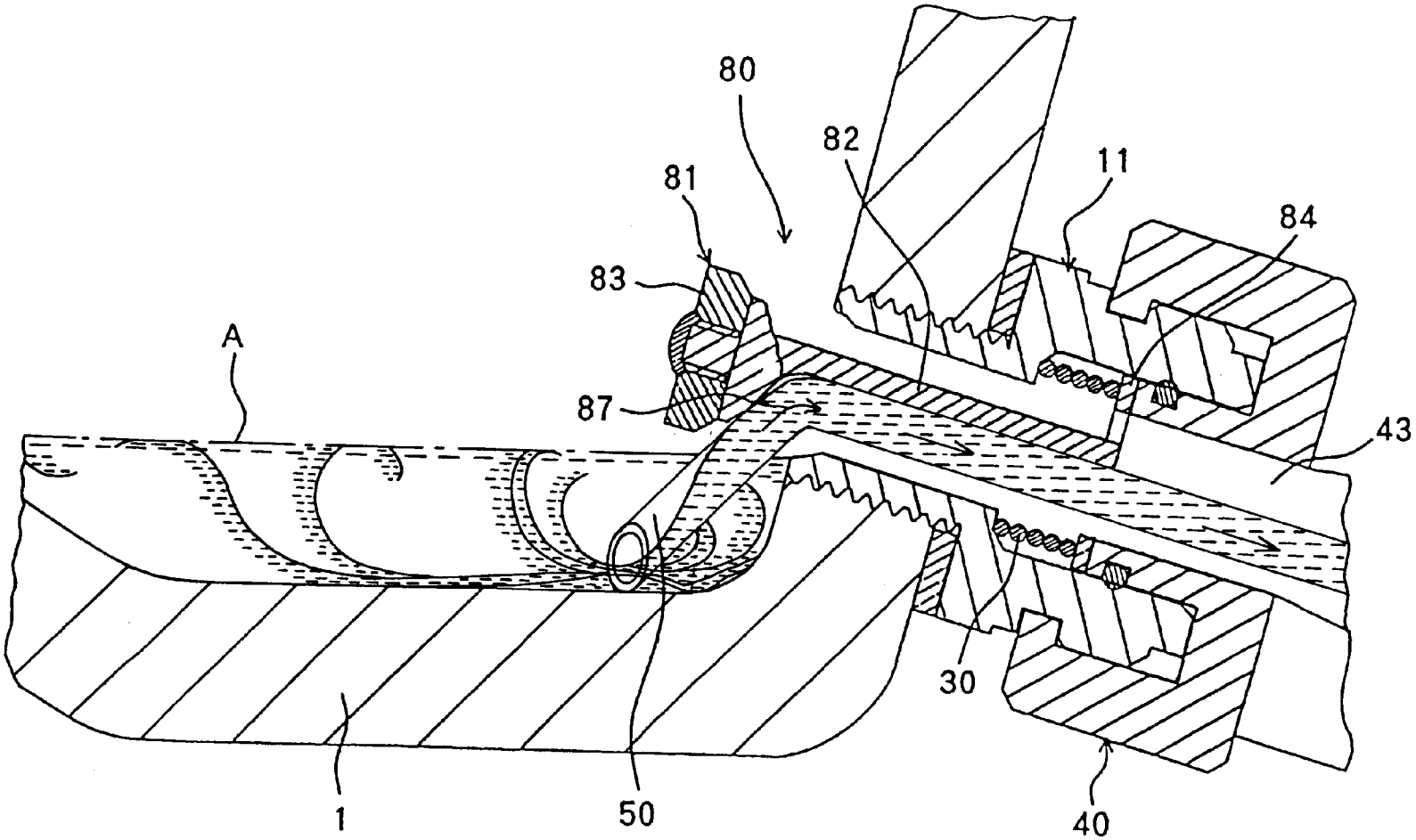
FIG. 9 is a partly longitudinal sectional view showing a state where an oil drain plug in accordance with an embodiment 2 of the present invention is secured to the side wall surface of the oil pan to perform an oil draining operation.
Figure 10A:
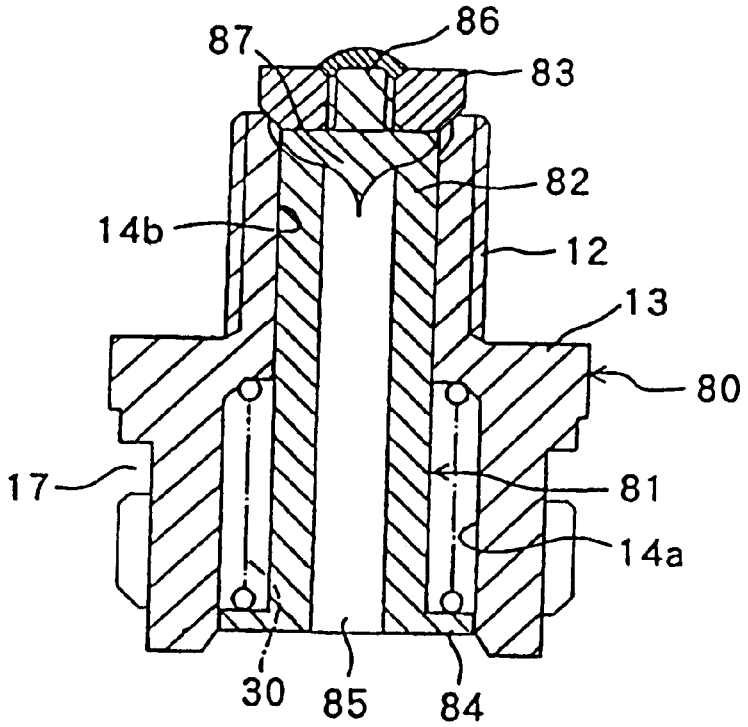
FIG. 10 is a diagram showing an oil drain plug and a valve body member of the embodiment 2, in which (a) is a longitudinal sectional view of the oil drain plug, (b) is a longitudinal side elevational view of the valve body member, (c) is a top sectional view of the connecting shaft at its intermediate position in the axial direction and (d) is a top sectional view of the connecting shaft in the vicinity of a spring seat.
Figure 10B:
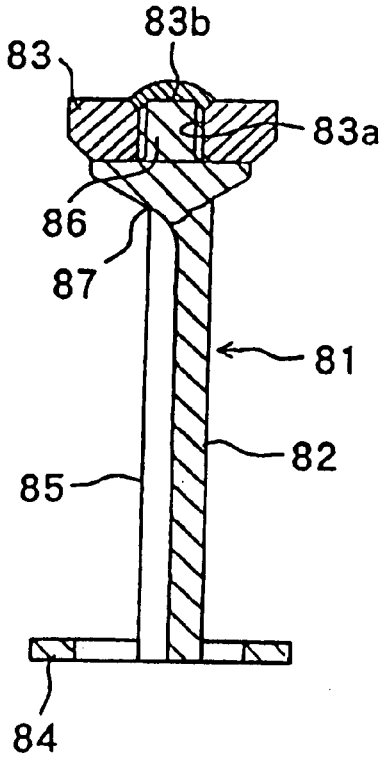
Figure 10C:
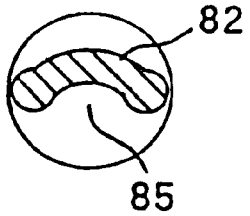
Figure 10D:
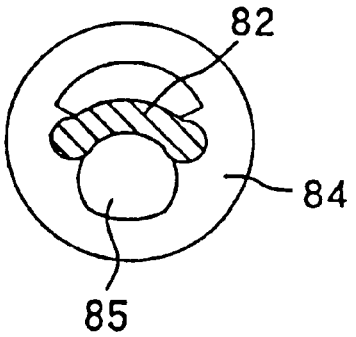
Figure 11A:
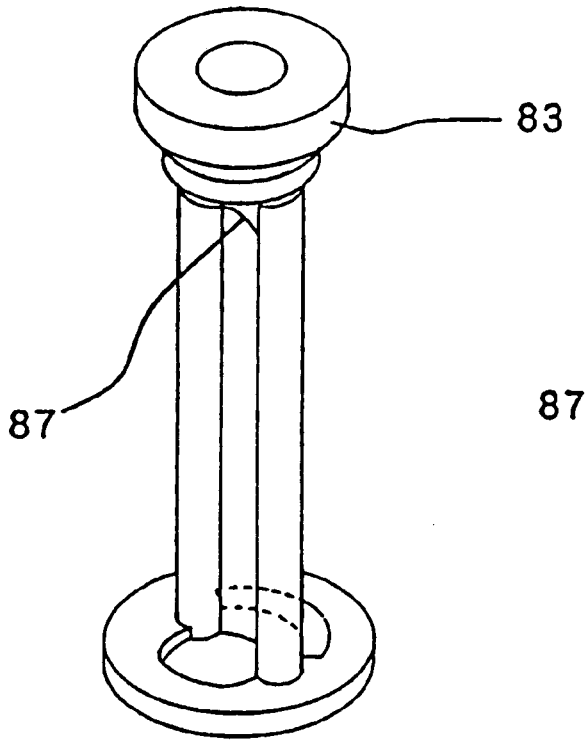
FIG. 11 is a diagram for explaining the valve body member of the embodiment 2, in which (a) is an external perspective view of the valve body member of the embodiment 2, (b) is an external perspective view of the valve body member in the case where a seal ring is fitted thereto and (c) is a diagram showing various sectional contours of the connecting shaft.
Figure 11B:
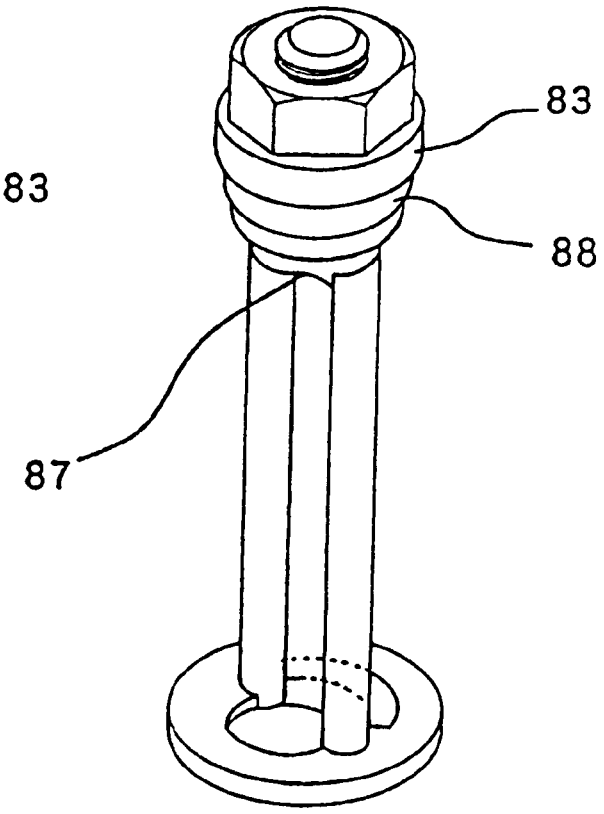
Figure 11C:
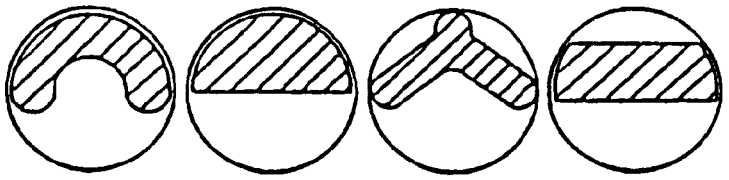

This embodiment shown in FIGS. 9 to 11 is different from the embodiment 1 in the structure of a valve body member 81 of an oil drain plug 80, although in respect to the others it is the same as the embodiment 1 and is used in the same manner as the embodiment 1. Hence, the other members or elements than the valve body member 81 are designated by the same reference numerals and are not again described.

More specifically, the valve body member 81 of this embodiment comprises as shown in FIGS. 9 and 10 a connecting shaft 82 located at a position offset relative to the central axis of the valve body 83 and the annular spring seat 84 (which coincides with the central axis of the through-holes 14*a*, 14*b* in the bolt member 11) so that the interior of the through-hole 14 (14*a*, 14*b*) of the bolt member 11 is partitioned into a large-section portion and a small-section portion, with the partitioned large-section portion being used as a tube passage 85 for the tube 50. Reference numeral 86 denotes a threaded rod projecting from the tip of the connecting shaft 82, reference numeral 83*a* denotes a threaded portion fixedly screwed onto the threaded rod 86, reference numeral 83*b* denotes a weld portion, and reference numeral 87 denotes an arcuate guide surface for guiding and delivering the tube 50 inserted into the tube passage 85, from the opened normally-closed valve portion into the oil pan 1.

An oil drain plug having the thus constructed valve body member 81 of this embodiment can be used for the drain of oil as shown in FIG. 9 in the same manner as the above embodiment 1. Since the connecting shaft 82 is disposed at an offset position, it is possible to form the tube passage 85 having a sufficiently large sectional area, which allows a large-diameter tube to be used as the oil suction tube 50, which is advantageous in that a smooth oil drain is assured even in the case of a high-viscosity oil used in cold districts in particular. Furthermore, the arcuate guide surface 87 and the associated elements ensure a smooth and secure insertion of the tube 50 into the oil pan.

It is natural that the valve body member in which the connecting shaft of this embodiment is provided at an offset position is not limited to the one having the structure shown in FIGS. 9 and 10 and that it can be any one as long as it has a strength structure enough to make up the normally-closed valve and has a sectional area of the tube passage ensuring a smooth and secure tube insertion. FIG. 11 illustrates a valve body member having a structure of such an example, in which FIG. 11(*a*) shows an example of the valve body member set forth in the embodiment 2; FIG. 11(*b*) shows an example in which a seal ring 88 made of rubber or the like is attached to the valve body portion; and FIG. 11(*c*) exemplarily shows some sectional shapes of the connecting shaft.

Embodiment 3

Figures 12A, 12B:
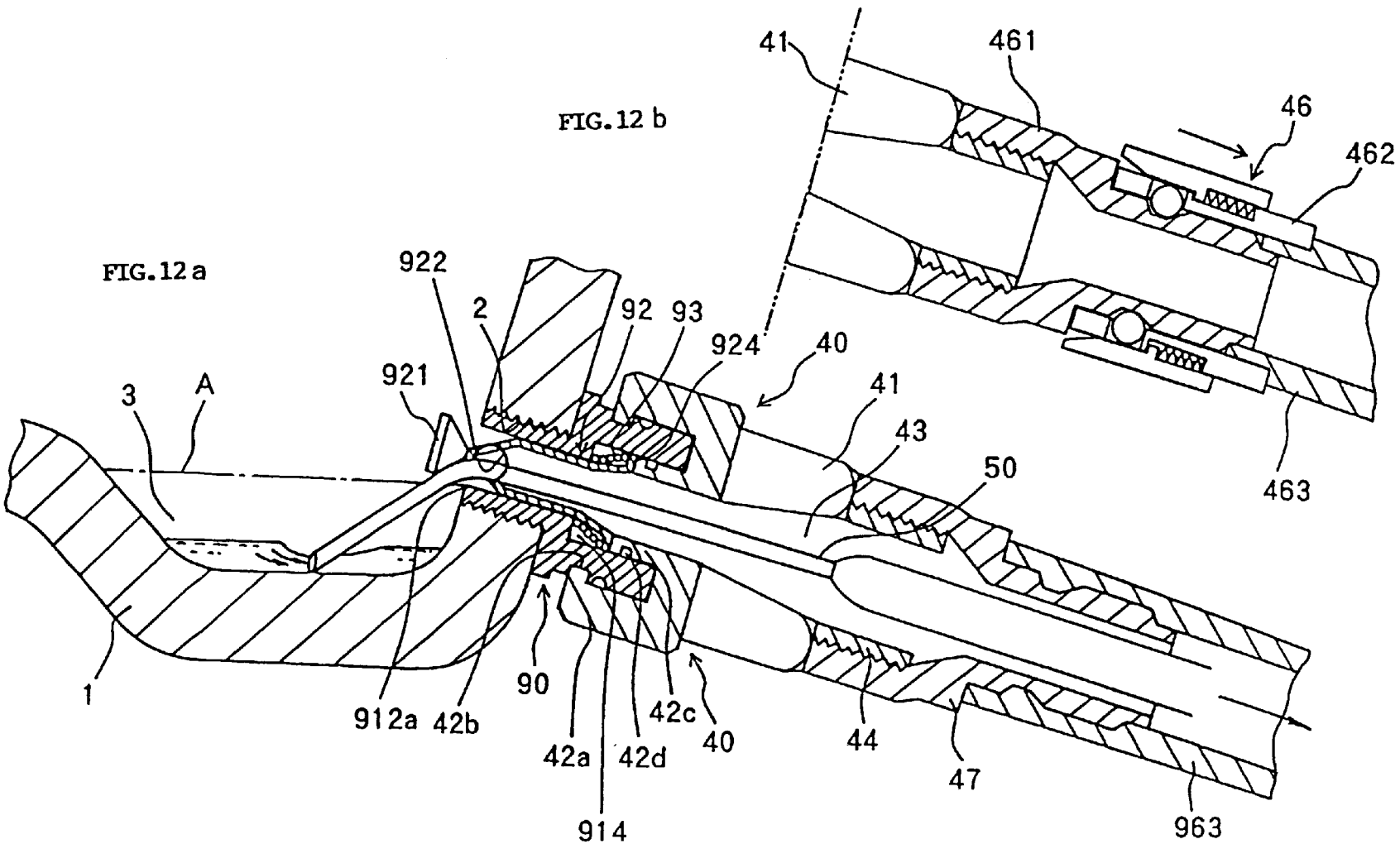
FIG. 12(*a*) is a longitudinal sectional view showing a state where an oil drain plug in accordance with an embodiment 3 of the present invention is secured to the side wall of the oil pan to perform an oil draining operation, and FIG. 12(*b*) is a partly sectional view showing a case using a one-touch coupler.
Figure 13A:
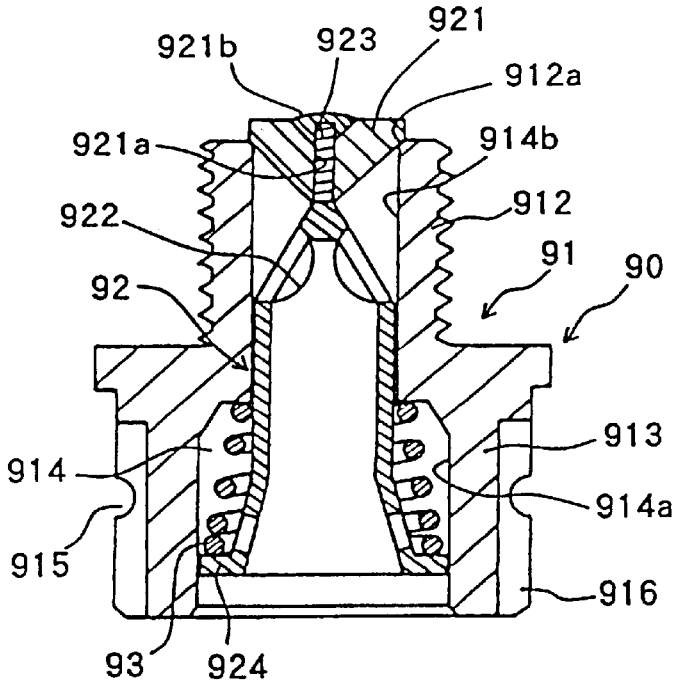
FIG. 13 is a diagram showing a detailed structure of the oil drain plug of FIG. 12, in which (a) is an general longitudinal sectional view, (b) is a front elevational view of the valve body and (c) is a general front elevational view.
Figure 13B:
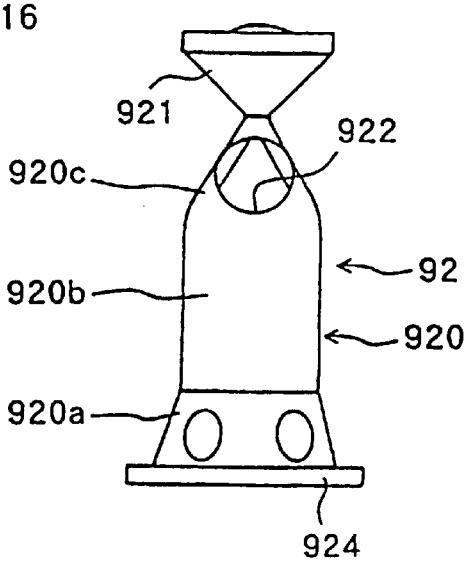
Figure 13C:
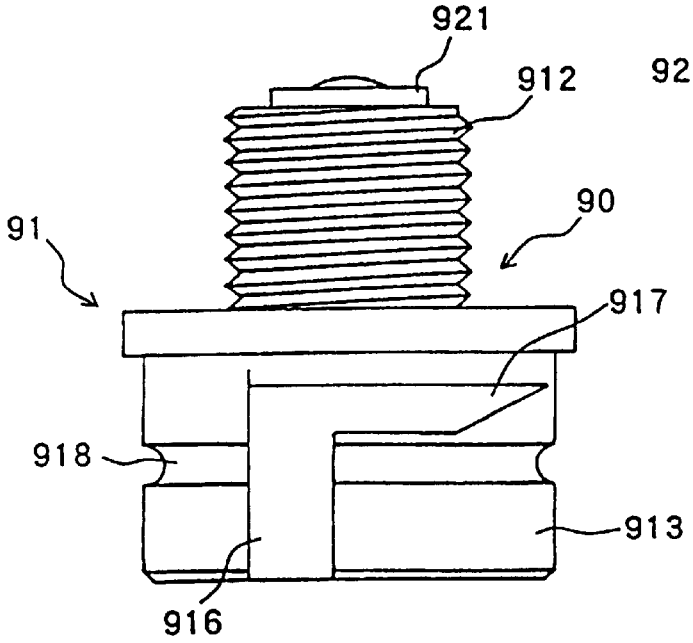

This embodiment illustrated in FIGS. 12 and 13 differs from the embodiment 1 in the structure of a valve body member 92 of an oil drain plug 90, but in respect to the other elements it is substantially the same as the embodiment 1 and is used in the same manner as the embodiment 1.

The details of the oil drain plug 90 of this embodiment are shown in FIG. 13. A bolt member 91 has substantially the same structure as that of the bolt member 11 of the embodiment 1 shown in FIG. 4. The bolt member 91 includes an externally threaded stem 912 at its fore-end portion, a head 913 at its rear end portion continuous with the threaded stem 912 and having a larger diameter, and a stepped through-hole 914 (914*a*, 914*b*) (with a larger diameter step in the region of the bolt head) extending from the fore-end portion to the rear end portion.

It is to be noted that in the case of the bolt member 91 of this embodiment, a cap fitting groove 918 for the rubber cap 60 fitted to the bolt head 913 is provided separately from a retainer groove 917 for mounting and retaining the valve body pressing jig 40. Incidentally, reference numeral 916 denotes an adapter mounting groove extending in the generatrix direction.

This embodiment is characterized by the structure of the valve body member 92, which is shown in (a) and (b) of FIG. 12. That is, a cap-like body 920 is so shaped as to have, starting from an annular spring seat 924, through a tapered portion 920*a* and a straight cylindrical portion 920*b*, a tapered tip 920*c*, with a threaded rod 923 projecting from its end (upper end of FIG. 13(*a*)). A threaded portion (female thread) 921*a* of a conical valve body 921 is screwed onto the threaded rod 923 in an inverted conical manner to be integrated therewith. The flared base of this conical valve body 921 is of a diameter larger than the diameter of the through-hole opening edge of the threaded stem 912 of the bolt member 91 so that when the valve body 921 is seated on the opening edge 912*a* acting as a valve seat, the opening can be closed in a liquid-tight manner. In the vicinity of its tapered tip, the valve body member 92 is provided with an open hole 922 for allowing a communication between the interior and exterior. At its rear end (the lower end of FIG. 13(*a*)), the valve body member 92 is provided with a spring seat 924 engaged with a coiled spring 93. Incidentally, reference numeral 921*b* denotes a weld portion at the through-tip of the threaded rod 923 screwed into the valve body 921, the weld portion 921*b* serving to firmly integrate the threaded rod 923 with the valve body 921, to thereby completely prevent any oil leakage.

The coiled spring 93 is received in the through-hole 914 of the bolt member 91, with its one end engaged with a stepped shoulder of the through-hole 914, with its other end engaged with the spring seat 924 of the valve body member 92, whereby the valve body member 92 is subjected to a spring force acting toward the bolt head, to thereby ordinarily open the valve (see FIG. 13(*a*)).

According to the oil drain plug 90 of this embodiment having the above construction, during the ordinary time (FIG. 13(*a*)), the valve body member 92 is biased by a spring force of the coiled spring 93 toward the bolt head 913 so that the valve body 921 is seated on the valve seat 912*a*, to keep the valve passage always closed.

Then, the adapter 40 is inserted through the opening in the region of the bolt head 913 to thrust the valve body member 92 toward the threaded stem 912 so that the valve body member 92 compresses the coiled spring 93 to be biased (displaced) toward the threaded stem 912, allowing the valve body 921 to be disengaged from the valve seat 912*a* to open the opening/closing valve. Accordingly, as shown in FIG. 12, the threaded stem side (i.e., the interior of the oil pan) leads to the exterior (external air), starting from the thus opened opening/closing valve, via the open hole. 922 of the valve body member 92 and through the opening in the region of the spring seat 924 of the valve body member 92.

FIG. 12(*a*) illustrates a case where an oil suction hose 963 is directly connected to the oil drain adapter 40.

FIG. 12(*b*) illustrates a case where the coupler 46 is used in the same manner as the embodiment 1 to allow the adapter 40 to be replaceably attached to the oil suction hose 463 or to the oil suction tube 50, with a male coupler 461 being connected to the adapter 40, with a female coupler 462 being connected to the oil suction hose 946, and with another male coupler 464 being previously connected to the tube 50, thereby enabling all the amount of the oil remaining within the oil pan 1 to be drained off by a negative pressure suction. That is, the female coupler 462 is uncoupled from the male coupler 461 integral with the adapter 40, and the another male coupler 464 (see FIG. 2) integral with the tube 50 is coupled to the female coupler 462 to use it in the same manner as FIG. 2.

In the case of the construction of FIG. 12(*a*) on the other hand, a flexible oil drain tube 50 fitted in the adapter 40 is used as follows to perform the operation for draining the oil remaining on the bottom of the oil pan 1 by a negative pressure suction by means of a vacuum pump. That is, use is made of the adapter 40 having one end to which an oil drain hose 963 is previously connected by way of the connector 47 (the other end of the hose is connected to the vacuum pump (not shown)) in such a manner that the oil drain adapter 40 is attached to the bolt member 91 of the oil drain plug 90. At that time, in the case of using the oil drain adapter 40 with the flexible oil drain tube 50 being fitted in the through-hole 43, axially expandable and contractible bellows (not shown) are provided on the hose 463 at a certain point (typically, in the vicinity of the connector 47). When the adapter 40 is fitted to the oil drain plug 90, the bellows are expanded to keep the end of the flexible oil drain tube 50 from projecting from the extremity of the oil drain adapter 40 or slightly projected therefrom. After the fitting operation, the axial dimensions of the bellows are reduced so that the end of the flexible oil drain tube 50 is inserted from the open hole 922 of the valve body member 92 through the opened valve into the interior of the oil pan 1, thereby ensuring that the flexible oil drain tube 50 does not interfere with the fitting operation of the oil drain adapter 40 and ensuring a subsequent smooth insertion of the flexible oil drain tube 50 into the oil pan 1.

Although the valve body member 92 of the oil drain plug 90 of this embodiment is not provided particularly with a guide surface for guiding the end of the tube 50, the cap-like body 920 of the valve body member 92 has a tapered tip so that the tube end can naturally be led into the open hole 922 formed in the region of the taper, thereby ensuring a smooth insertion of the tube.

In either case where the flexible oil drain tube 50 is replaced with the oil suction hose 463 by means of the coupler 46 or where use is made of the oil drain adapter 40 with the tube 50 fitted previously therein, the device of the present invention can achieve a secure discharge of oil or sludge unwillingly remaining on the bottom of the oil pan, which could not been expected by the conventional device. Thus, its advantage will be significant.

Embodiment 4

Figure 14A:
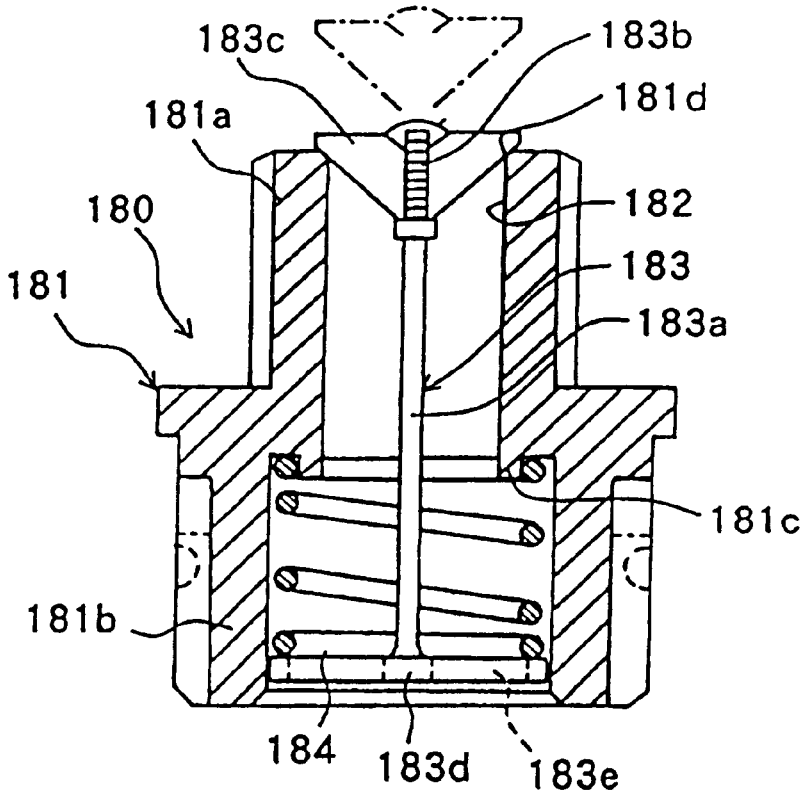
FIG. 14 is a diagram showing an oil drain plug in accordance with an embodiment 4 of the present invention, in which (a) is a longitudinal front elevational view and (b) is a perspective view of the valve body.
Figure 14B:
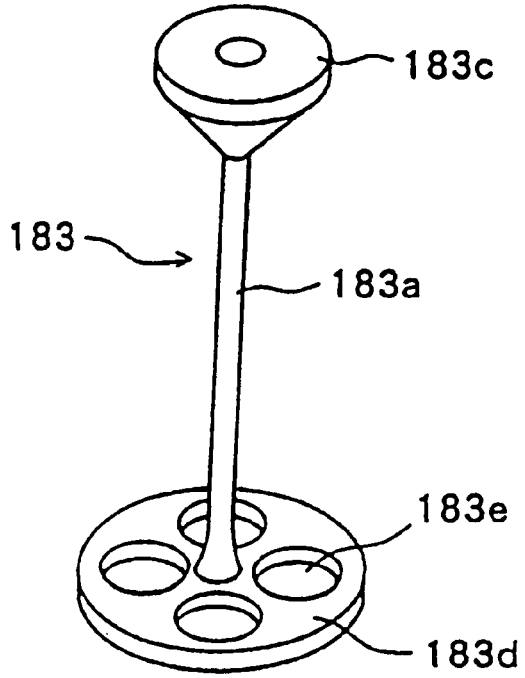

This embodiment illustrated in FIG. 14 differs from the embodiments 1 to 3 in that use is made without inserting the oil suction tube 50, although a bolt member 181, a valve body 183 and a coiled spring 184 of an oil drain plug 180 have basically the same structure and function as those of these embodiments and can be used in the same manner.

That is, the bolt member 181 includes a threaded stem 181*a* and a bolt head 181*b* which are the same in the external structure as those of the embodiment 1. The bolt member 181 includes a through-hole 182 having a stepped structure with a small diameter in the region of the threaded stem 181*a* and with a large diameter in the region of the bolt head 181*b*, with a stepped edge between the small-diameter portion and the large-diameter portion being formed with an axial flange 181*c* circumferentially extending for positioning one end of the coiled spring 184, with this axial flange 181*c* defining a recess for receiving the coiled spring 184.

The valve body 183 as shown in FIG. 14(*b*) includes an elongated rod-like stem 183*a*, a threaded portion 183*b* formed at one end of the stem 183*a*, a conical valve seat engagement portion 183*c* similar to the embodiment 1 which is screwed integrally onto the threaded portion 183*b* in an inverted conical manner, and a spring seat 183*d* in the form of a bored disk formed on the other end of the stem 183*a* and extending orthogonal to the stem 183*a*. Reference numeral 183*e* denotes oil drain holes provided in the disk acting as the spring seat.

The thus constructed oil drain plug 180 of this embodiment can be used in the same manner as the embodiments 1 to 3 such that during the ordinary operation shown in FIG. 14(*a*), a spring force of the coiled spring 184 causes the valve seat engagement portion 183*c* to be seated on the through-hole opening edge (valve seat 181*d*) of the threaded stem 181*a* of the bolt member 181 to thereby close the opening/closing valve. Then, the oil drain adapter 40 set forth in the embodiment 3 is fitted to the bolt member 181 so that the valve body 183 is displaced to a position indicated by a chain-dotted line in the diagram toward the threaded stem 181*a* (upward in FIG. 14(*a*)) to thereby disengage the valve seat engagement portion 183*c* from the valve seat 181*d* to release the opening/closing valve. This allows the oil residing within the oil pan 1 to be drained off.

This embodiment also achieves a prevention of oil leakage by the closure of the normally-closed valve during the ordinary time as well as a simple oil draining operation when necessary. In addition, the valved plug of this embodiment is extremely simple in structure and superior in mass-productivity, making it possible to provide products at lower costs.

Embodiment 5

Figure 15:
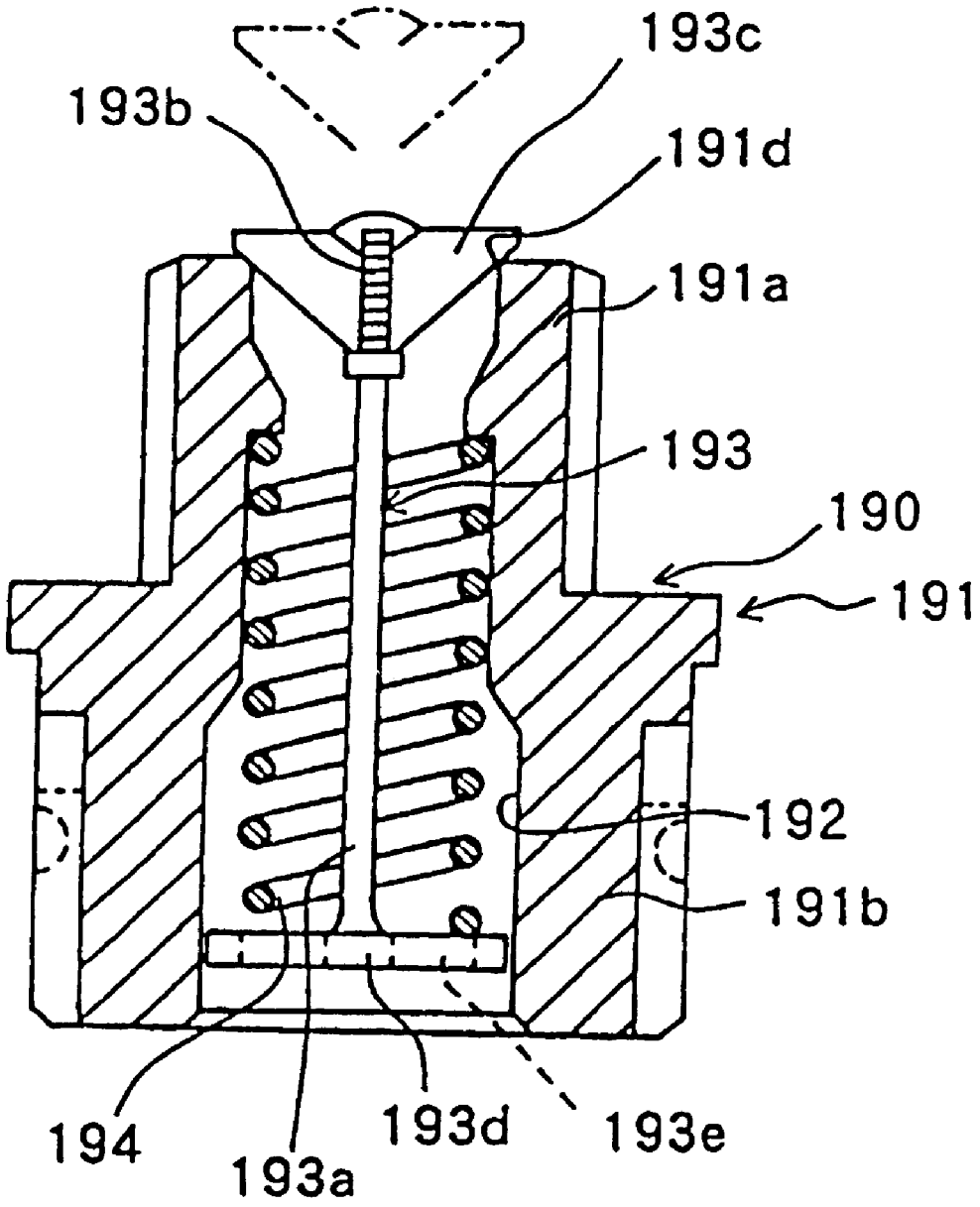
FIG. 15 is a longitudinal front elevational view showing an oil drain plug in accordance with an embodiment 5 of the present invention.

As compared with the embodiment 4, an oil drain plug 190 of this embodiment illustrated in FIG. 15 is characterized in that the bolt member 191 has a three-stepped through-hole 192 so as to allow an axially elongated coiled spring to be accommodated in the through-hole 192. The other construction is the same as the embodiment 4. Hence, the same members and structures are designated by reference numerals similar to the embodiment 4 but with the addition of 10 thereto and will not again be described.

In the same manner as the embodiment 4, this embodiment also achieves a blockage of the oil drain hole during the ordinary time as well as a simple oil draining operation when necessary. Furthermore, this embodiment employs the elongated coiled spring 194 extending beyond a half of the axial length of the oil drain plug 190 so that there are assured a larger compression length (valve body displacement stroke) and therefore a larger disengagement length of the valve seat engagement portion 193*c* from the valve seat 191*d* when the normally-closed valve is released, with the result that a smooth oil flow upon the oil draining operation is achieved and that it becomes possible to provide products at lower costs due to its extremely simple structure and superior mass-productivity.

INDUSTRIAL APPLICABILITY

According to the invention of the oil drain plug and the invention of the oil drain device which will be defined in claims of this application, as described hereinabove, a larger diameter of the normally-closed valve is assured by using as the valve seat the large diameter opening edge of the through-hole provided at the tip of the threaded stem of the bolt member, and a larger stroke of the valve body member (valve body) can be set by the spring means such as the coiled spring or the like arranged within the through-hole of the bolt member, with the result that a larger valve passage is assured during the release of the normally-closed valve and that there can be achieved a smooth and secure insertion of the oil suction tube into the interior of the vessel such as the oil pan by virtue of the guide surface formed in the movable valve body member. Thus, it is possible to perform a simple and secure oil draining operation and to thereby drain off all the amount of the oil and sludge even in the case where the oil drain plug is fitted to the side wall surface of the oil pan or the like with the end of the tube hanging down onto the bottom of the oil pan or the like or the case where the oil pan or the like has a structure in which the bottom thereof is provided with a backing member for securing the threaded hole length.

In addition to those, the inventions defined in the claims present the following effects.

According to the invention of claim 2, the movable valve body member has a cylindrical trunk portion, so that when inserted through the cylindrical trunk portion, the oil suction tube can be smoothly and gradually orientated without its tip being caught, thereby making it possible to drain off all the amount of oil and sludge without leaving the oil.

According to the invention of claim 3, the oil drain passage (tube passage) within the bolt member can have an enlarged sectional area so that a smooth insertion of the tube can be achieved by the guide surface provided on the connecting shaft.

According to the invention of claim 4, it is possible to control the orientation of the tube inserted through the plug into the oil storing vessel so as to securely point the tube toward the vessel bottom.

According to the invention of claim 5, it is possible to provide a valved plug with a built-in normally-closed valve in the form of a very simple structure.

According to the invention of the oil drain device defined in claim 7, all the amount of the oil within the vessel can be securely drained off by use of the oil suction hose and the oil suction tube.

According to the invention of claim 8, the oil drain device is mounted with the valved plug defined in claims 1 to 5 so that a secure and smooth operation of the tube can be achieved with a simpler oil change work.

According to the invention of claim 9, the drain of oil remaining on the bottom of the oil pan can be achieved by a simple operation including removing the end of the oil suction hose from the valve body pressing jig and then fitting it to the oil suction tube.

What is claimed is:

1. An oil drain plug for an oil storing vessel, said oil drain plug comprising:

a bolt member having at one end side thereof a threaded stem fixedly screwed into an oil drain hole of said oil storing vessel, having at the other end side thereof a head positioned outside of said oil storing vessel, having an oil drain passage axially through-formed and extending from said threaded stem to said head, and having a valve seat disposed in said oil drain passage at an end closer to said threaded stem;

a movable valve body member having at one end thereof a valve body engageable with said valve seat to close said oil drain passage, said valve body being accommodated within said oil drain passage in such a manner that said valve body is movable toward the interior of said oil storing vessel to disengage said valve seat to open said oil drain passage for draining off oil; and a spring member accommodated within said oil drain passage of said bolt member, said spring member generating a spring force for urging said movable valve body member to engage said valve seat; wherein said head of said bolt member is provided with a mounting portion for a jig which moves said movable valve body member against spring force to keep said oil drain passage open, and wherein said movable valve body member is formed with a guide surface for allowing an extremity of a flexible oil suction tube inserted through said oil drain passage to be turned in a diagonally lower direction and to be led into the interior of said oil storing vessel when said jig opens said oil drain passage.

2. An oil drain plug for an oil storing vessel according to claim 1, wherein said movable valve body member includes a one-end-open cylindrical trunk portion having said valve body at one end side thereof and opened at the other end thereof, an opening formed in a side surface of said trunk portion in the vicinity of said one end side, for allowing a passage in the interior of said trunk portion to open to the exterior of said trunk portion, an annular spring seat positioned within said oil drain passage of said bolt member in the region of said head, said spring seat being engaged by said spring member, and said guide surface leads said extremity of said oil suction tube from said opening at said other end side of said trunk portion, via said interior of said trunk portion and through said opening in the side surface of said trunk portion, into the interior of said oil storing vessel.

3. An oil drain plug for an oil storing vessel according to claim 2, wherein said movable valve body member is rotatable around its longitudinal axis, with an identification mark indicative of a degree of rotation around said longitudinal axis of said movable valve body member so that a direction of guide of said guide surface formed on said movable valve body member is adjustable around said longitudinal axis.

4. An oil drain plug for oil storing vessel according to claim 3, wherein said oil storing vessel is an oil pan of an automobile.

5. An oil drain plug for oil storing vessel according to claim 2, wherein said oil storing vessel is an oil pan of an automobile.

6. An oil drain plug for an oil storing vessel according to claim 1, wherein said movable valve body member includes an annular spring seat positioned within said oil drain passage of said bolt member in a region of said head, said spring seat being engaged by said spring member, and a rod-like connecting shaft for connecting said spring seat and said valve body, said connecting shaft being disposed at a position off-center relative to a longitudinal axis of said oil drain passage of said bolt member, to thereby form a section having a larger sectional area for the insertion of said oil suction tube in the region of its center, said connecting shaft having a side surface forming at least a portion of said surface.

7. An oil drain plug for an oil storing vessel according to claim 6, wherein said movable valve body member is rotatable around its longitudinal axis, with an identification mark indicative of a degree of rotation around said longitudinal axis of said movable valve body member so that a direction of guide of said guide surface formed on said movable valve body member is adjustable around said longitudinal axis.

8. An oil drain plug for oil storing vessel according to claim 7, wherein said oil storing vessel is an oil pan of an automobile.

9. An oil drain plug for oil storing vessel according to claim 6, wherein said oil storing vessel is an oil pan of an automobile.

10. An oil drain plug for an oil storing vessel according to claim 1, wherein said movable valve body member is rotatable around its longitudinal axis, with an identification mark indicative of a degree of rotation around said longitudinal axis of said movable valve body member so that a direction of guide of said guide surface formed on said movable valve body member is adjustable around the longitudinal axis.

11. An oil drain plug for oil storing vessel according to claim 10, wherein said oil storing vessel is an oil pan of an automobile.

12. An oil drain plug for an oil storing vessel according to claim 1, wherein said oil storing vessel is an oil pan of an automobile.

13. An oil drain plug for an oil storing vessel, said oil drain plug comprising:

a bolt member having at one end side thereof a threaded stem fixedly screwed into an oil drain hole of said oil storing vessel, having at the other end side thereof a head positioned outside of said oil storing vessel, having an oil drain passage anally through-formed and extending from said threaded stem to said head, and having a valve seat disposed in said oil drain passage at an end closer to said threaded stem;

a movable valve body member having at one end thereof a valve body engageable with said valve seat to close said oil drain passage, said valve body being accommodated within said oil drain passage in such a manner that said valve body is movable toward the interior of said oil storing vessel to disengage said valve seat to open said oil drain passage for draining off oil; and a spring member accommodated within said oil drain passage of said bolt member, said spring member generating a spring force for urging said movable valve body member to engage said valve seat;

wherein said movable valve body member includes an annular or bored disk-like spring seat positioned within said oil drain passage of said bolt member in a region of said head, said spring seat being engaged by said spring member, and a solid-rod-like connecting shaft having a small diameter so as to form a large gap between said connecting shaft and an inner wall surface of said oil drain passage of said bolt member, said connecting shaft serving to connect said spring seat and said valve body.

14. An oil drain plug for oil storing vessel according to claim 13, wherein said oil storing vessel is an oil pan of an automobile.

15. An oil drain device for an oil storing vessel comprising a combination of:

a) an oil drain plug comprising a bolt member having at one end side thereof a threaded stem fixedly screwed into an oil drain hole of said oil storing vessel, having at the other end side thereof a head positioned outside of said oil storing vessel, having an oil drain passage axially through-formed and extending from said threaded stem to said head, and having a valve seat disposed in said oil drain passage at an end closer to said threaded stem; a movable valve body member having at one end thereof a valve body engageable with said valve seat to close said oil drain passage, said valve body being accommodated within said oil drain passage in such a manner that said valve body is movable toward the interior of said oil storing vessel to disengage said valve seat to open said oil drain passage for draining off oil; and a spring member accommodated within said oil drain passage of said bolt member, said spring member generating a spring force for urging said movable valve body member to engage said valve seat;

b) a valve body pressing jig fitted to said head of said bolt member, said jig being engageable with said movable valve body member to move said valve body towards the interior of the oil storing vessel to disengage said valve seat;

c) an oil suction hose removably fitted to said valve body pressing jig; and d) an oil suction tube for inserting, through said oil drain plug with its valve passage opened, into the interior of said oil storing vessel.

16. An oil drain device for an oil storing vessel according to claim 15, wherein said oil drain plug comprises the oil drain plug of claim 1.

17. An oil drain device for an oil storing vessel according to claim 16, wherein said oil suction hose has an extremity provided with a female coupler, and wherein said valve body pressing jig and said oil suction tube are each provided with a male coupler to be mated with said female coupler.

18. An oil drain device for an oil storing vessel according to claim 15, wherein said oil suction hose has an extremity provided with a female coupler, and wherein said valve body pressing jig and said oil suction tube are each provided with a male coupler to be mated with said female coupler.

19. An oil drain device for an oil storing vessel according to claim 15, wherein said oil drain plug comprises the plug of claim 2.

20. An oil drain device for an oil storing vessel according to claim 15, wherein said oil drain plug comprises the plug of claim 13.

* * * * *